US005941616A

United States Patent [19]

Billingham

[11] Patent Number: 5,941,616

[45] Date of Patent: Aug. 24, 1999

[54] BOX FRAME SYSTEM

[75] Inventor: Paul R. Billingham, Chiswick, United Kingdom

[73] Assignee: Delta Design Development Limited, London, United Kingdom

[21] Appl. No.: 09/021,725

[22] Filed: Feb. 11, 1998

[30] Foreign Application Priority Data

May 15, 1997 [GB] United Kingdom ..... 9709934

[51] Int. Cl.[6] ..... F16B 12/00

[52] U.S. Cl. ..... 312/111; 312/208.1

[58] Field of Search ..... 312/107, 108, 312/111, 198, 203, 235.5, 235.2, 249.8, 245, 184, 183, 208.1; 108/53.1, 91; 206/503, 593; 297/352

[56] References Cited

U.S. PATENT DOCUMENTS

| | | | |
|---|---|---|---|
| 1,179,258 | 4/1916 | Willard . | |
| 1,966,672 | 7/1934 | Lang . | |
| 1,974,552 | 9/1934 | Wallbank . | |
| 2,135,401 | 11/1938 | Kiff . | |
| 2,454,307 | 11/1948 | Cooley . | |
| 2,557,630 | 6/1951 | Brown | 312/107 |
| 2,746,109 | 5/1956 | Budai . | |
| 3,179,278 | 4/1965 | Cohen . | |
| 3,238,004 | 3/1966 | Goebel . | |
| 3,287,075 | 11/1966 | Batke et al. . | |
| 3,391,967 | 7/1968 | Schreyer | 312/111 X |
| 4,053,101 | 10/1977 | Hart, Jr. . | |
| 4,060,169 | 11/1977 | Hildebrand et al. . | |
| 4,125,302 | 11/1978 | Peritz et al. | 312/245 X |
| 4,128,167 | 12/1978 | Hogshead, III . | |
| 4,155,311 | 5/1979 | Jackovin | 108/91 X |
| 4,239,306 | 12/1980 | Klaus | 312/111 |
| 4,341,339 | 7/1982 | Zore . | |
| 4,673,087 | 6/1987 | Webb | 206/503 X |
| 4,744,487 | 5/1988 | Welborn . | |
| 4,817,861 | 4/1989 | Henrikson . | |
| 5,441,151 | 8/1995 | Billingham . | |
| 5,470,141 | 11/1995 | Billingham . | |
| 5,501,356 | 3/1996 | Billingham . | |
| 5,564,805 | 10/1996 | Dickinson | 312/249.8 |
| 5,620,243 | 4/1997 | Billingham . | |

FOREIGN PATENT DOCUMENTS

| | | |
|---|---|---|
| 537147 | 4/1993 | European Pat. Off. . |
| 577668 | 1/1994 | European Pat. Off. . |
| 1761138 | 4/1971 | Germany . |
| 2124160 | 11/1972 | Germany . |
| 2847726 | 7/1979 | Germany . |
| 3307994 | 9/1984 | Germany . |
| 222953 | 10/1924 | United Kingdom . |
| 2148256 | 5/1985 | United Kingdom . |
| 90/05643 | 5/1990 | WIPO . |

*Primary Examiner*—Janet M. Wilkens
*Assistant Examiner*—Karlena D. Schwing
*Attorney, Agent, or Firm*—Senniger, Powers. Leavitt & Roedel

[57] ABSTRACT

A system for constructing modular furniture from one or more file boxes. The system includes a rigid rectangular frame having top and bottom faces adapted to engage the file boxes. The top face has a rim extending up from the top face for surrounding a file box mounted on the top face. The bottom face has a rim extending down from the bottom face for surrounding a file box mounted on the bottom face.

14 Claims, 26 Drawing Sheets

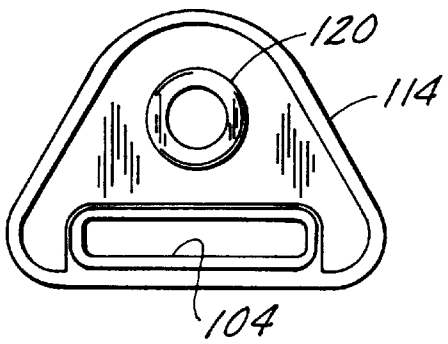
FIG. 7a
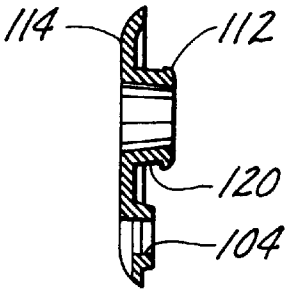
FIG. 7b
FIG. 7c
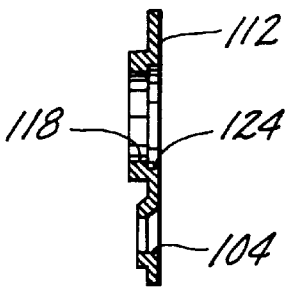
FIG. 7e
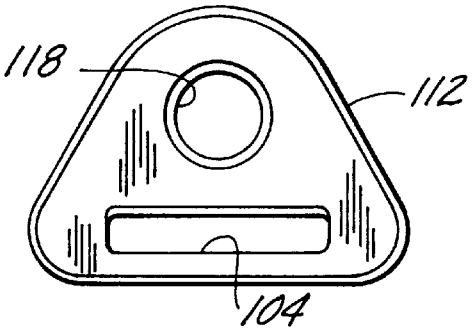
FIG. 7d
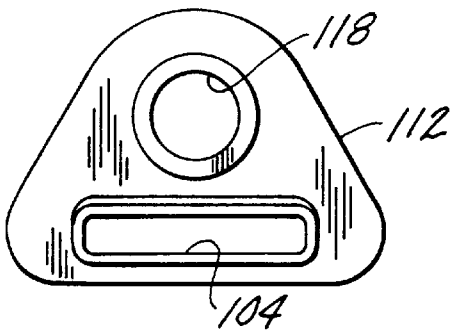
FIG. 7f 126
110
106
108
106

126
108
110
108
126

126
110
108
126

126
110

110
126

114
110
120
114
112
124
112
128
108
108
128
112
124
118
112
106
54
54

23

192
180
184
182
186
190
110
106
110
40
106
54
110
106
110
40
134
134
23

BOX FRAME SYSTEM

BACKGROUND OF THE INVENTION

This invention relates to modular furniture and storage systems, and more particularly although not exclusively, to a system for constructing modular furniture from one or more file boxes.

Co-assigned European Patent No. 0537147, which is hereby incorporated by reference, discloses a system of archive file boxes adapted for assembly in various configurations by means of interconnecting clips fitting in slots. Co-assigned British Patent Application No. 9709934.5, which is hereby incorporated by reference, discloses a system for constructing modular furniture from file boxes. The present invention provides an improved and more versatile box stacking and interconnection system which is also suitable for use with prefabricated boxes such as those formed from folded cardboard blanks. The invention also provides a system for building rigid structures using boxes or other prefabricated parts to form furniture such as desks, storage units, chairs and tables.

SUMMARY OF THE INVENTION

Briefly, apparatus of the present invention includes a system for constructing modular furniture from one or more file boxes. The system comprises a rigid rectangular frame having top and bottom faces adapted to engage the file boxes. The top face has a rim extending up from the top face for surrounding a file box mounted on the top face, and the bottom face has a rim extending down from the bottom face for surrounding a file box mounted on the bottom face.

Other features of the present invention will be in part apparent and in part pointed out hereinafter.

BRIEF DESCRIPTION OF THE DRAWINGS

FIG. 7*a*–7*f* are a front elevation, vertical cross section and rear elevation of an outside socket member half, and a front elevation, vertical cross section and rear elevation of an inside socket member half, respectively;

Corresponding reference characters indicate corresponding parts throughout the several views of the drawings.

DETAILED DESCRIPTION OF THE PREFERRED EMBODIMENT

Figure 1:
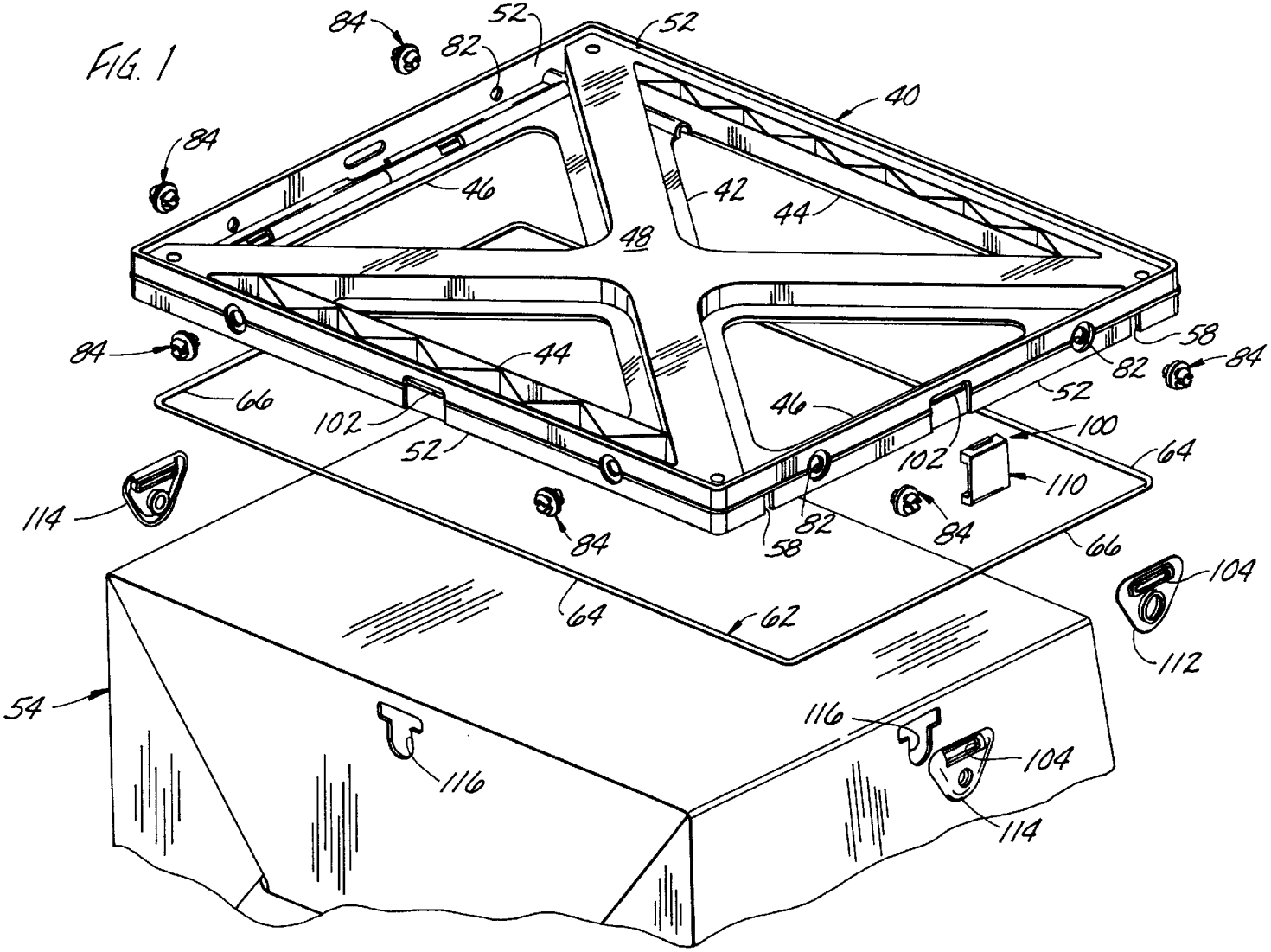
FIG. 1 is an exploded perspective of a frame and file box assembly in accordance with the present invention.

Referring to the drawings and in particular to FIG. 1, a frame is designated in its entirety by the reference numeral 40. The frame 40 includes an X-shaped central reinforcing body 42, a pair of longer side members 44, and a pair of shorter end members 46. The upper and lower surfaces of the reinforcing body 42 form upper and lower faces 48, 50, respectively, (FIG. 2) of the frame 40. The side and end members 44, 46 include a rim 52 which extend up and down from the reinforcing body 42 (and therefore, above and below the upper and lower faces 48, 50 of the frame 40) for cooperating with file boxes, generally designated by 54, mounted on the upper and/or lower faces, respectively. (Only one file box positioned for mounting on the lower face of the frame is shown in FIG. 1.) Thus, the frame 40 can be seated on a file box 54, and a second file box (not shown) can be seated in the tray structure formed by the upwardly projecting rim 52 of the frame 40. The cooperation between the frame 40 and the file boxes 54 reinforces the connection between the file boxes 54 when they are stacked. Although other materials are envisioned as being within the scope of the present invention, the frame 40 of the preferred embodiment is formed from molded plastic such as polypropylene.

Figure 2:
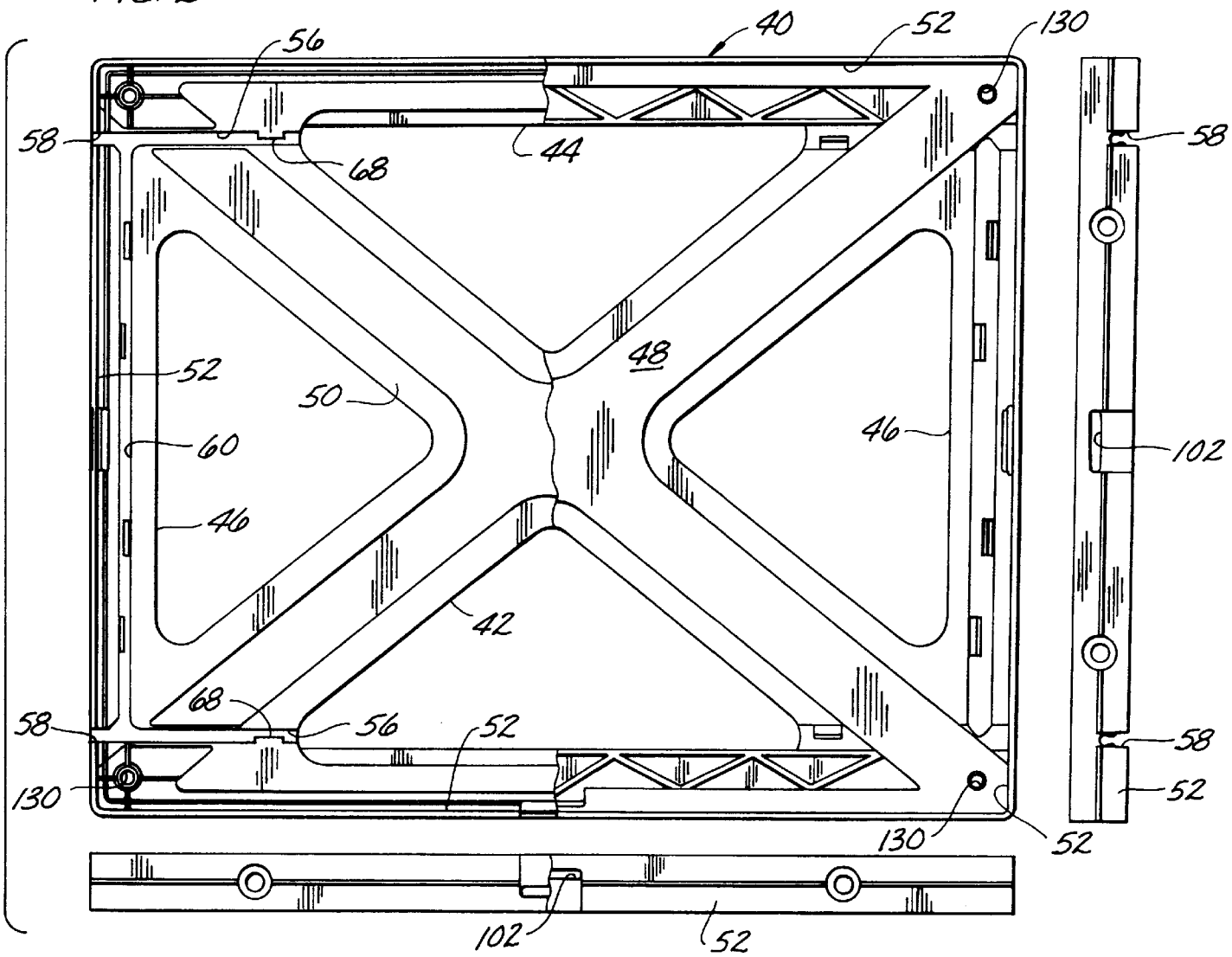
FIG. 2 is a orthographic projection of the frame showing fragmentary top and bottom plans, fragmentary front and rear elevations, and a right side elevation of the frame.

As illustrated in FIG. 2, the underside of the frame 40 includes longitudinal channels 56 extending parallel to the side members 44 and terminating in apertures 58 extending through the rim 52 of the end members 46. The longitudinal channels 56 interconnect with lateral channels 60 extending parallel to the end members 46. As shown in FIG. 1, the longitudinal and lateral channels 56, 60 are adapted to accommodate a rigid rectangular bridging member, generally designated 62, having sides 64 which are longer than the side members 44 of the frame 40 and ends 66 which are shorter than the end members 46 of the frame. Although other materials are envisioned as being within the scope of the present invention, the bridging member 62 of the preferred embodiment is made from steel rod.

Figure 3:
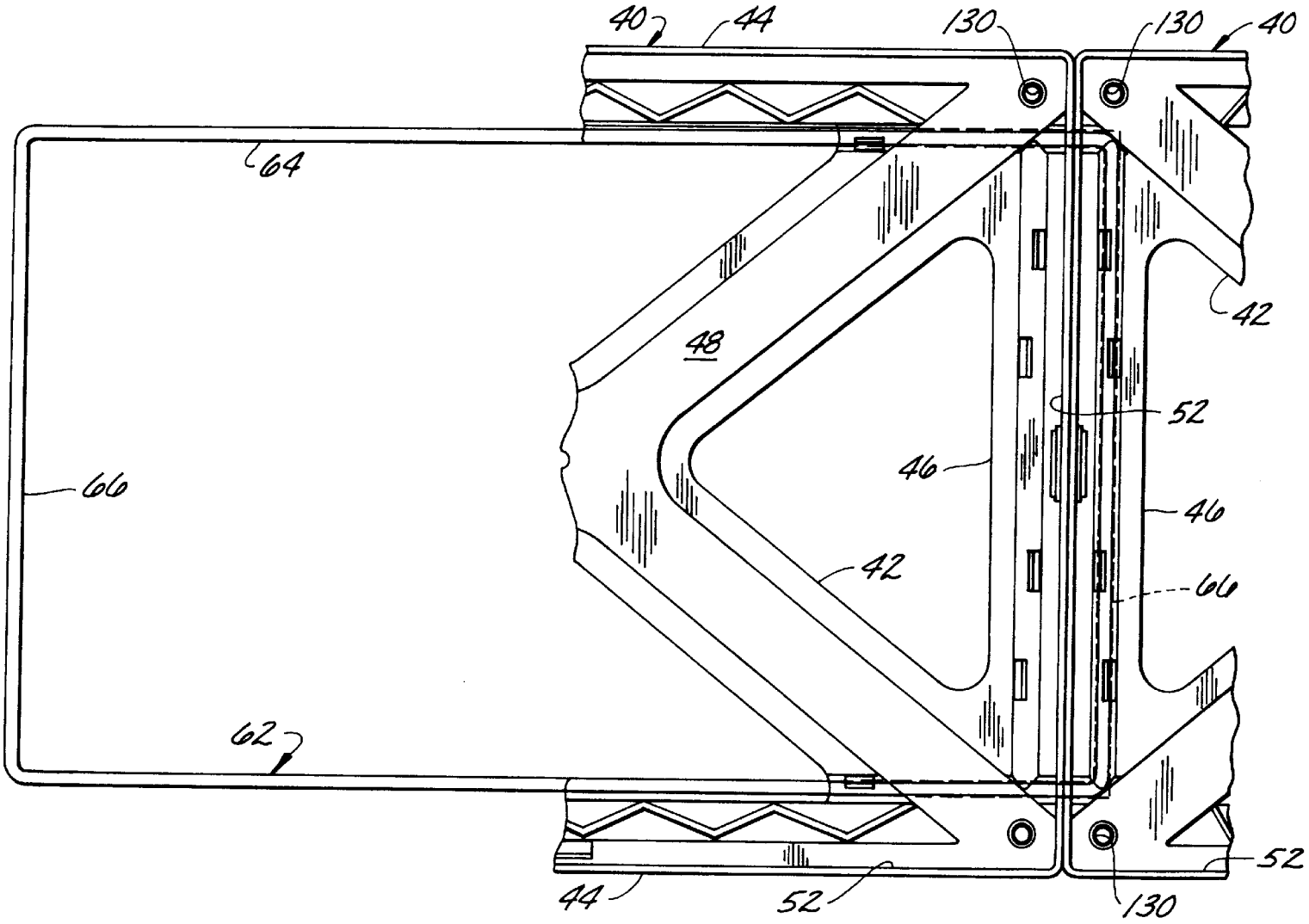
FIG. 3 is a fragmentary top plan of two frames joined by a bridging member.
Figure 4:
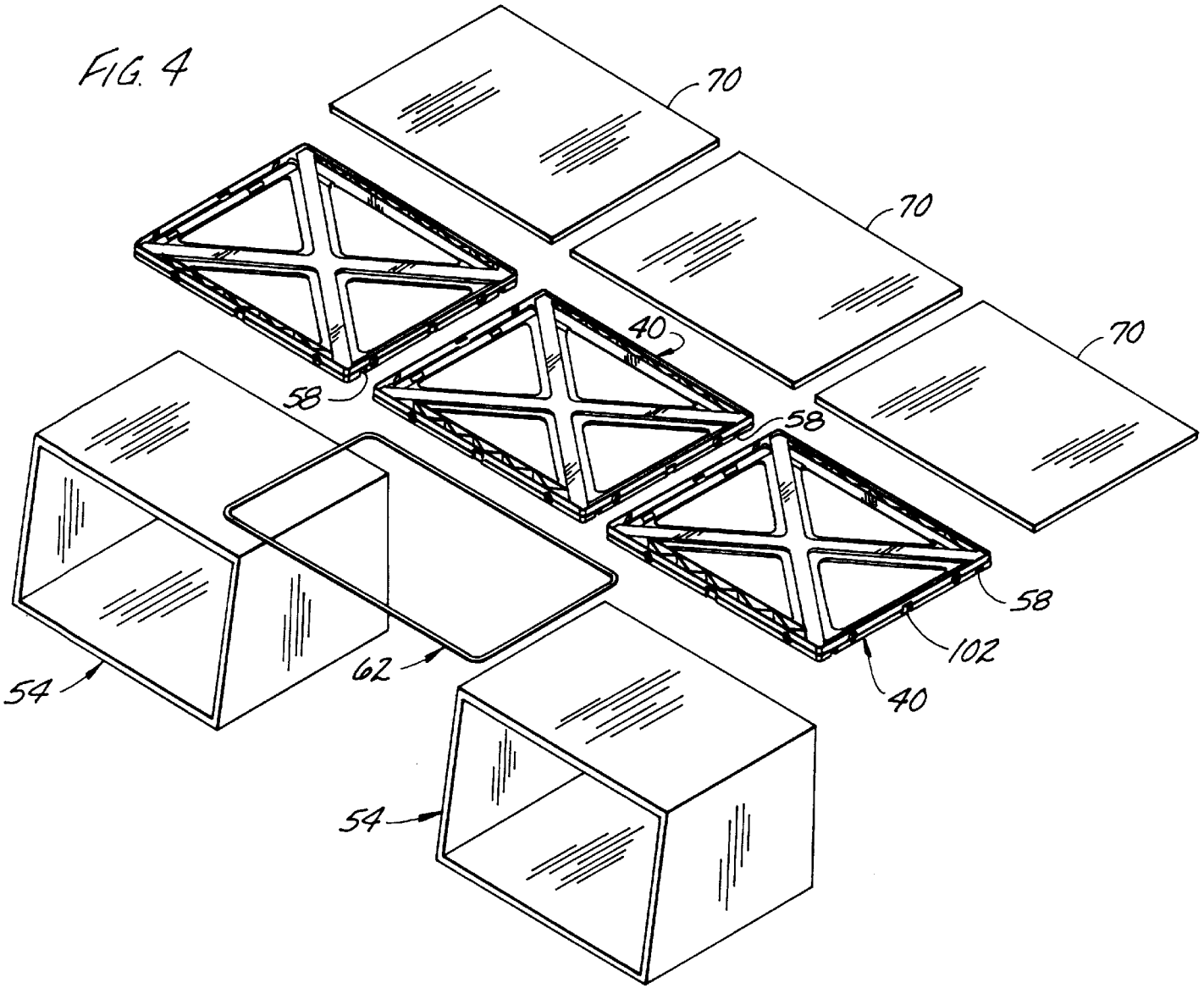
FIG. 4 is an exploded perspective of an assembly constructed with the frame and a bridging member of the present invention.

The bridging member 62 may be mounted on the frame 40 by manually pressing the sides 64 of the bridging member into the longitudinal channels 56 of the frame. As shown in FIG. 2, each of the longitudinal channels 56 has a lug 68 extending inward into the channel from one side for engaging the bridging member 62 to releasibly hold the member in the channel. When the bridging member 62 is so mounted, the ends 66 of the bridging member are exposed as shown in FIG. 3. Mounting the bridging member 62 on a frame 40 enables the construction of an assembly in which a frame is supported by bridging member suspended between two boxes 54 spaced by a distance equal to the width of a file box as shown in FIG. 4. As will be understood by those skilled in the art, the sides 64 of the bridging member 62 extend through the apertures 58 of the adjacent frame 40 as shown in FIG. 3 so the ends 66 of the bridging member engage the lateral channels 60 of the adjacent frame to prevent separation of the frames. Thus, the bridging member 62 not only supports the frame 40, but also locks it to the adjacent frames so that the entire assembly, including the file boxes 54, forms a rigid structure. The structure may be completed as shown in FIG. 4 by inserting suitable panels 70 of sheet material, such as medium density fiberboard, in the tray structure formed in the top of each frame 40. As will also be apparent to those skilled in the art, such construction may be used to form desks and other furniture having knee holes.

Figure 5:
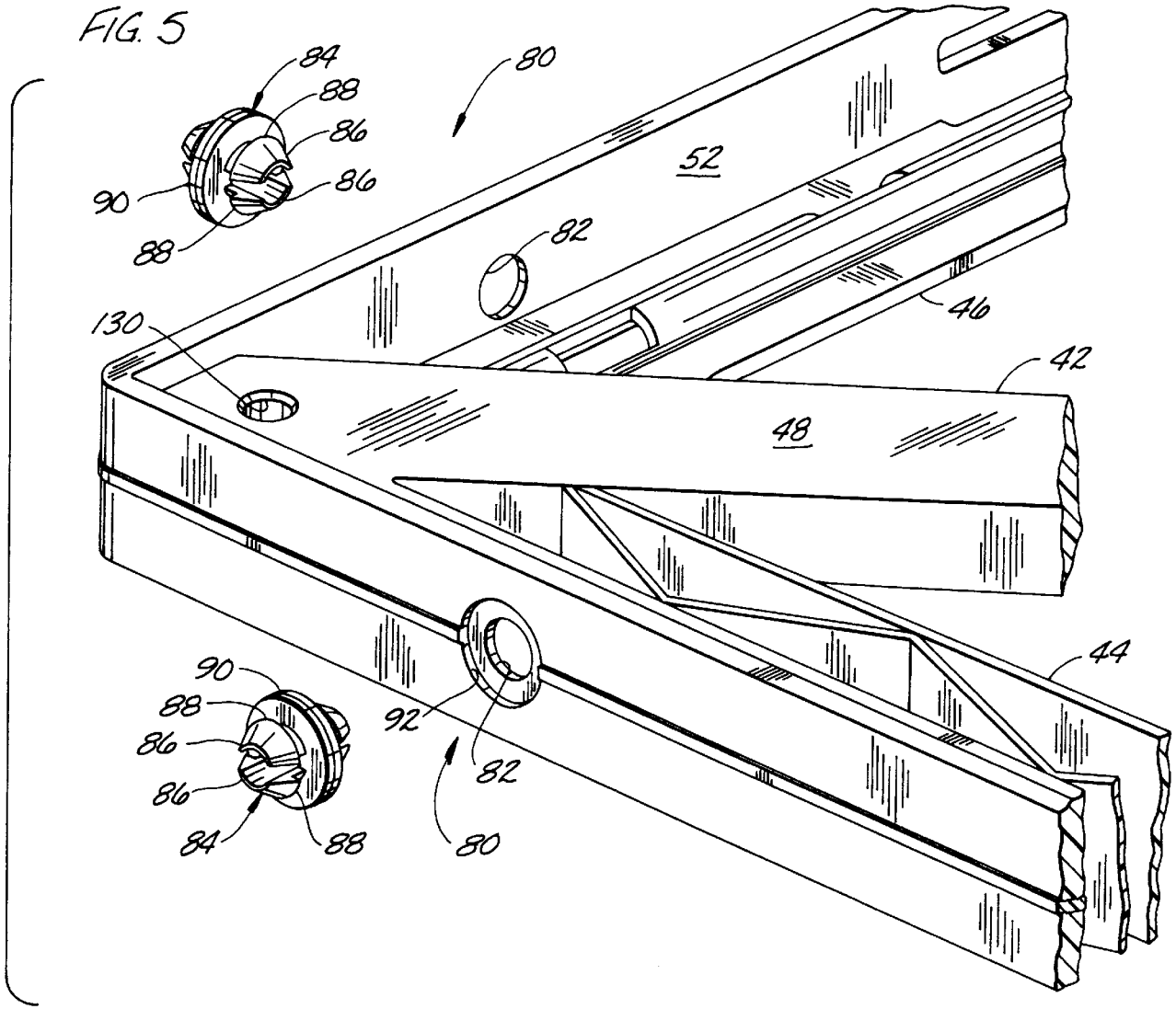
FIG. 5 is an enlarged fragmentary perspective of one corner of a frame showing plug-and-socket connectors.
Figure 6:
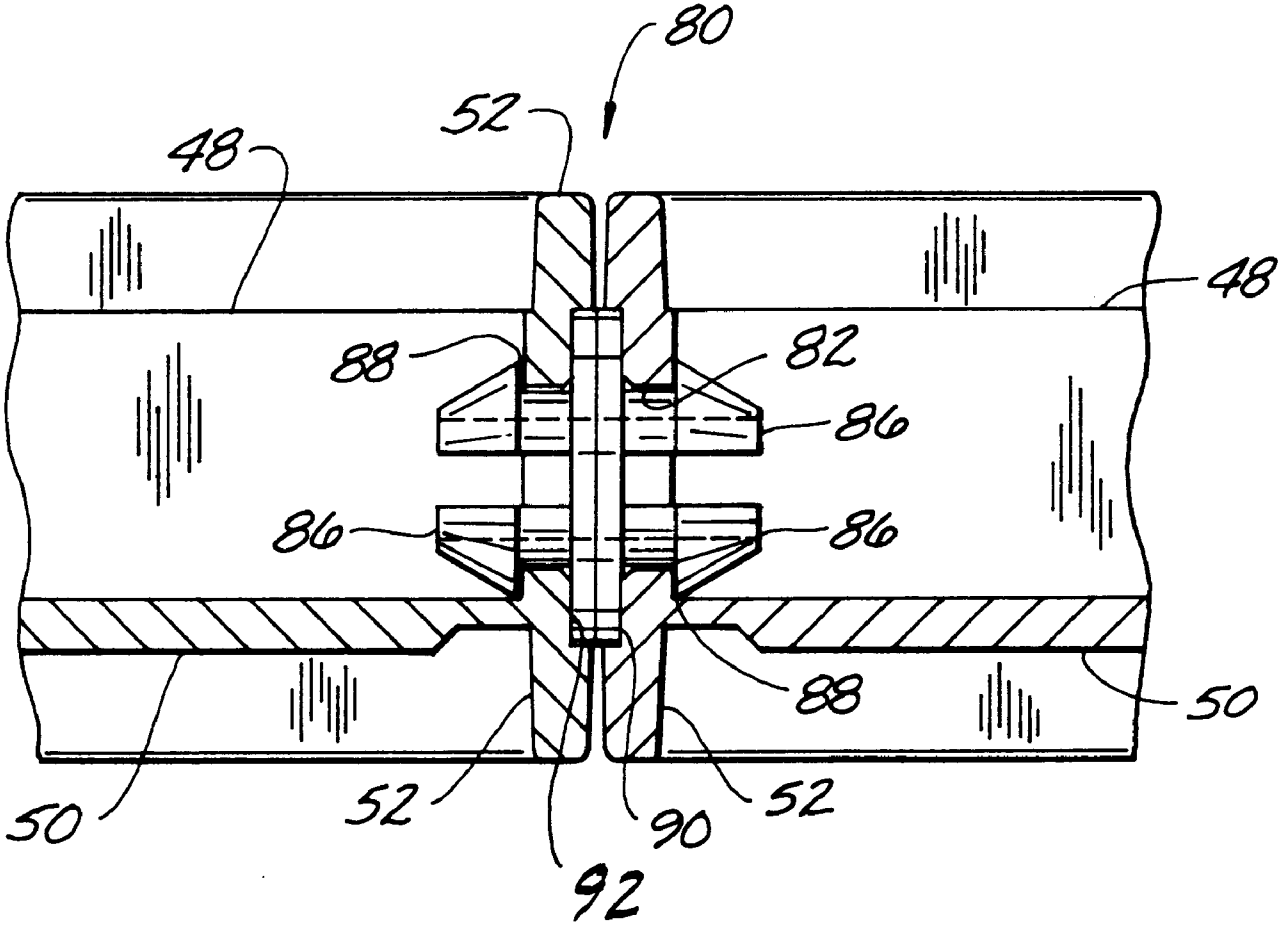
FIG. 6 is a fragmentary cross section of adjacent frames connected by a plug.

In addition to connecting the frames 40 with bridging members 62, the frames may also be connected by plug-and-socket connectors, generally designated by 80 in FIG. 5. Each frame 40 includes two sockets 82 through each rim 52 for receiving double-ended plugs 84 having a pair of deformable arms 86 at each end. The plugs 84 may be manually pressed into the sockets 82 of the frames 40. As the plugs 84 are pressed into the sockets 82, their arms 86 deform toward each other and snap back to their undeformed position when the plug is fully inserted and the arms 86 return to their undeformed position. Each arm 86 has a hook 88 on its end for holding the plug in place when it is fully inserted. FIG. 6 illustrates adjacent frames 40 being connected using connectors 80. A collar 90 provided around the middle of the plug 84 centers the plug between adjacent frames 40. Counterbores 92 formed around the sockets 82 permit the collar 90 to be recessed in the frame 40, thereby allowing the frames 40 to be brought closer together.

As illustrated in FIG. 1, a C-shaped clip connector, generally designated 100, may be used to join a frame 40 to a file box 54 positioned above or below the frame. Slots 102 are provided at the center of each end member 46 and at the center of the rear side member 44 of the frame 40. Corresponding slots 104 are also provided in molded plastic socket members, generally designated by 106, which are attached to the file boxes 54 as explained below. The slots 102, 104 receive legs 108 of a C-shaped clip, generally designated by 110, to connect a frame 40 and a box 54.

Figure 8:
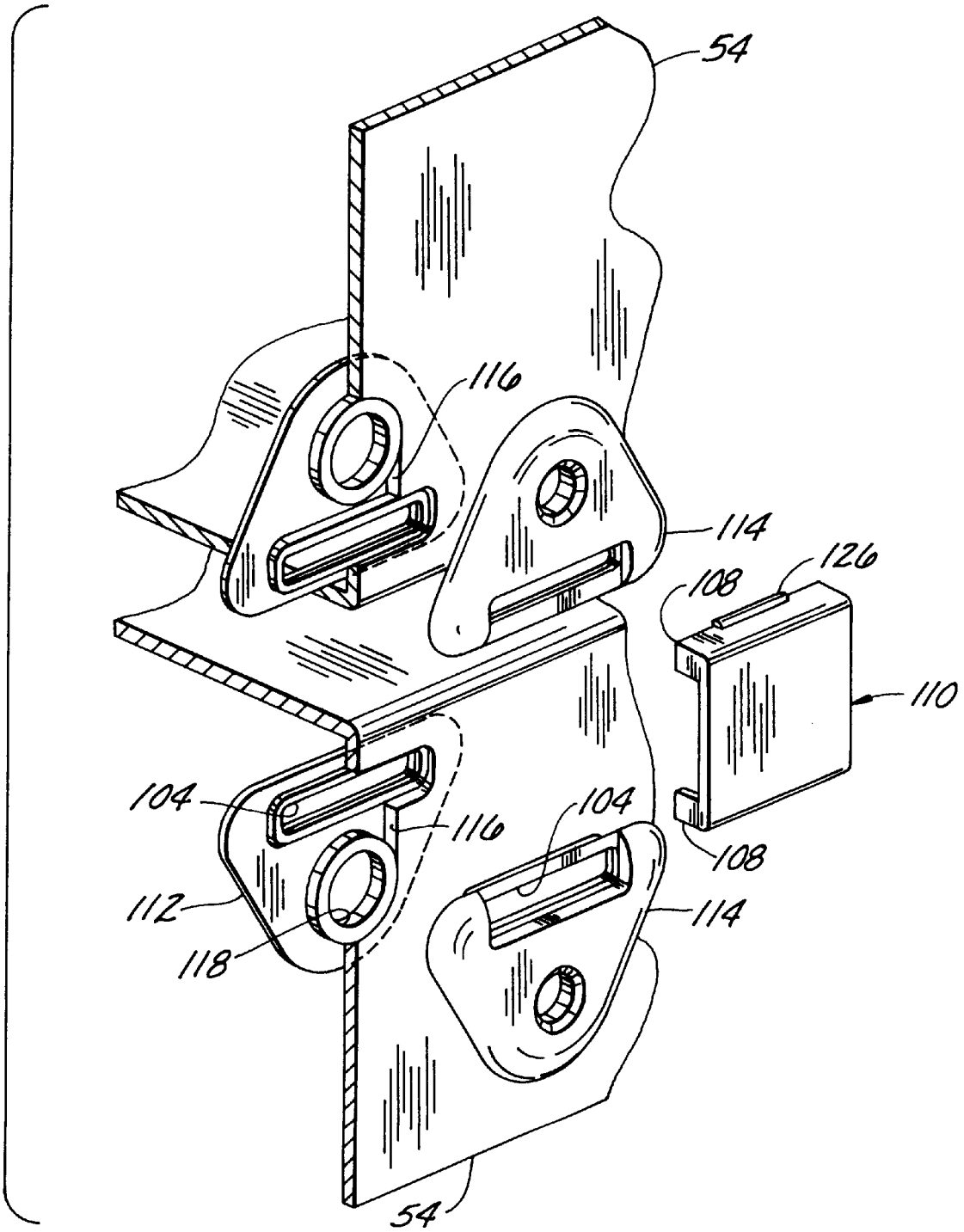
FIG. 8 is an exploded fragmentary view showing a connector for connecting stacked file boxes.

The construction of the socket members 106 is illustrated in detail in FIG. 7. Each socket member 106 comprises two generally triangular molded halves 112, 114 adapted to snap together through a generally T-shaped opening 116 (FIG. 1) provided in the side of the box 54 so that one half 112 is positioned inside the box and the other half 114 is positioned outside the box. FIGS. 7*a* to 7*c* illustrate a front elevation, a vertical cross section, and a rear elevation of the outside half 114 of the socket member 106, and FIGS. 7*d* through 7*f* illustrate corresponding views of the inside half 112 of the socket member. The inside half 112 has a hole 118 which is adapted to receive a cooperating tubular stud 120 extending from the outside half 114. The end of the stud 120 has a rim 122 sized to seat in a correspondingly enlarged annular recess 124 formed around the hole 118. Thus, the two halves 112, 114 lock together in the opening 116 in the box 54 as illustrated in FIG. 8. The slot 104 extends through each half 112, 114 of the socket member 106. When the halves 112, 114 are locked together, the slots 104 in each half are aligned and positively positioned with respect to the box 54.

Figures 9, 10A, 10B, 10C, 10D, 11:
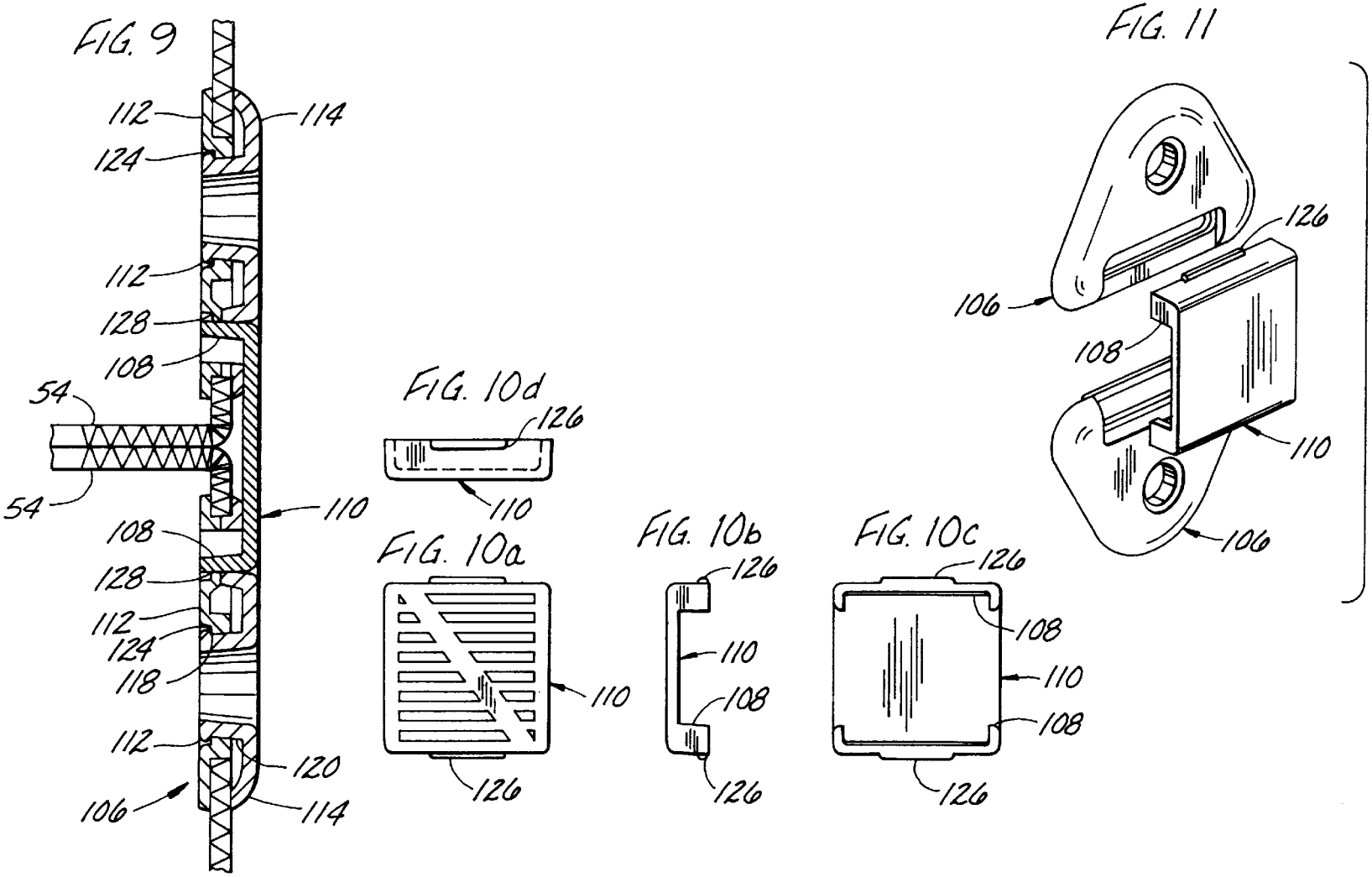
FIG. 9 is a vertical cross section taken through the connector and file boxes of FIG. 8 in an assembled condition.
FIG. 10*a*–10*d* are a front elevation, side elevation, top plan and rear elevation, respectively, of a clip for connecting stacked boxes.
FIG. 11 is an exploded perspective showing the connector of FIG. 10 in relation to assembled socket members.

The clip and socket arrangement can also be used to directly connect two boxes 54 stacked one atop the other as illustrated in FIGS. 8 and 9. FIG. 8 illustrates two socket members 106 in relation to stacked file boxes 54 and the legs 108 of the clip 110. FIG. 9 shows a vertical cross section through a clip 110 connecting two boxes 54. As can be seen in FIGS. 9–11, the legs 108 of the clip 110 have projections 126 which engage corresponding ledges 128 in the slot 104 on the inside half 112 of the socket member 106 to firmly lock the clip in position.

Figure 21:
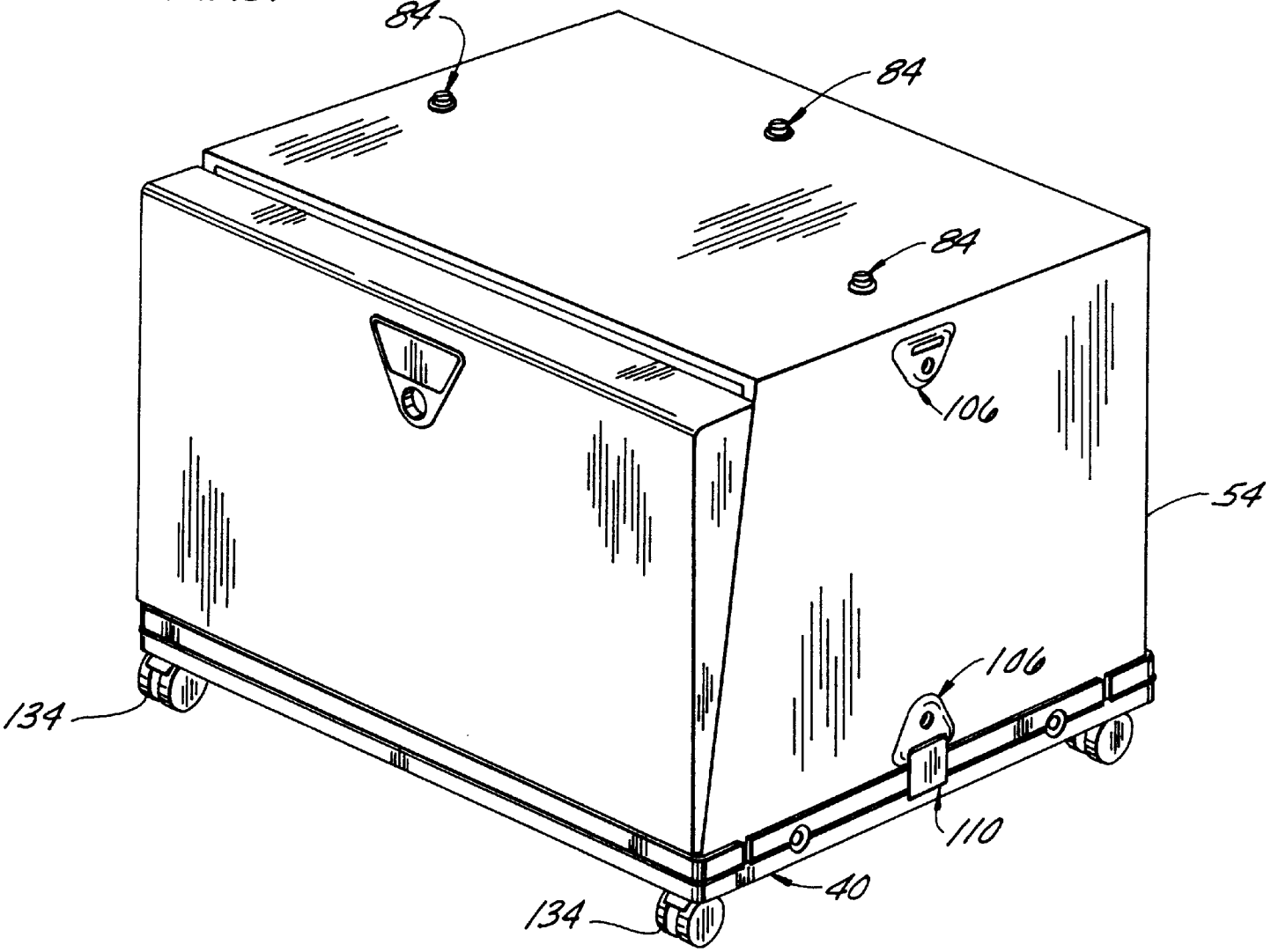
FIG. 21 is a perspective showing plug-and-socket connectors for connecting stacked boxes.

The plugs 84 for connecting adjacent frames 40 may also be used in combination with the clips 110 to connect boxes 54 stacked one on top of the other as shown in FIG. 21. When used to connect stacked boxes 54, the plugs 84 are inserted in holes (not shown) in the top and bottom of the boxes. As will be understood by those skilled in the art, the plugs 84 strengthen the connection between the stacked boxes when used in this way.

Figure 12C:
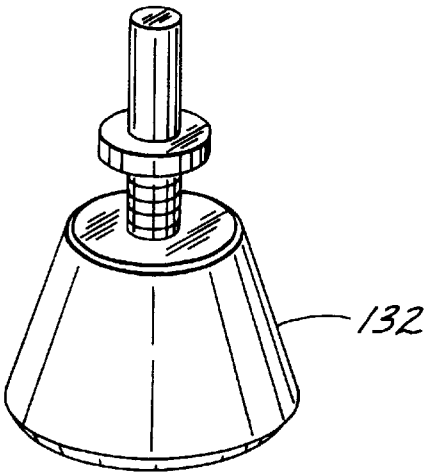
FIGS. 12*a*–12*c* are a front elevation, top plan and perspecive of a furniture foot, respectively.
Figure 13:
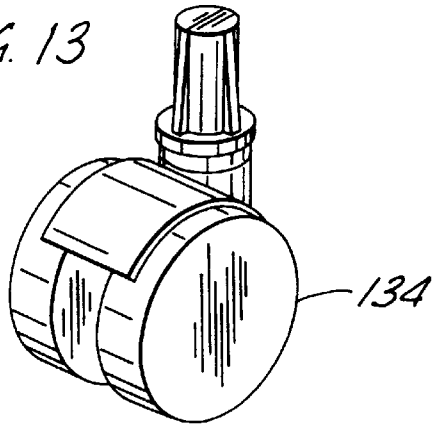
FIG. 13 is a perspective of a furniture castor.
Figure 12A:
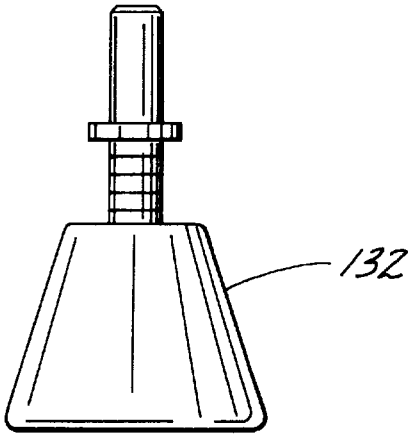
Figure 12B:
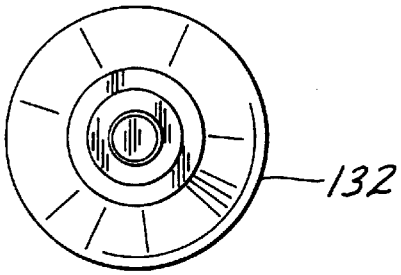
Figure 14:
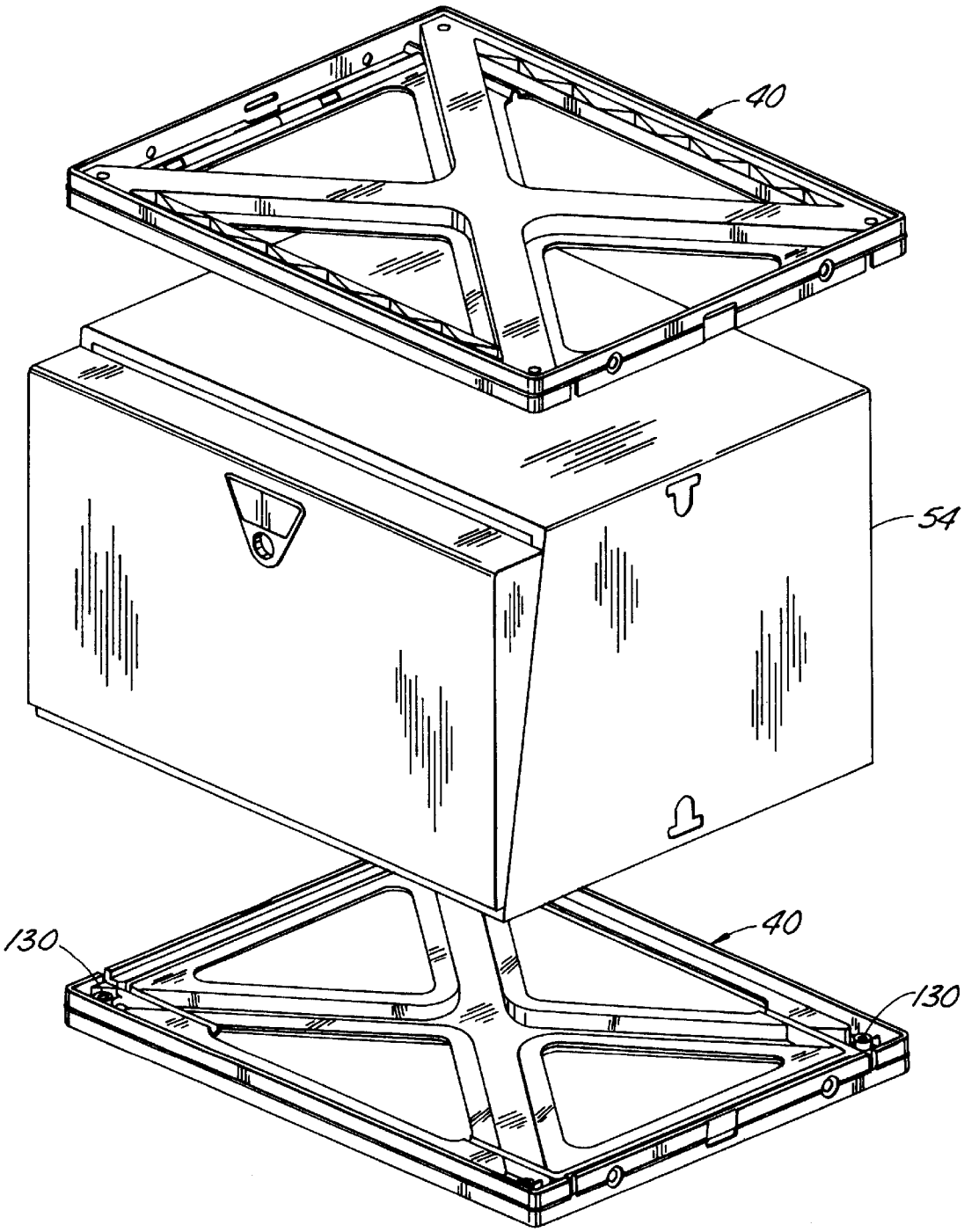
FIG. 14 is an exploded perspective showing a file box with top and bottom frames.
Figure 15:
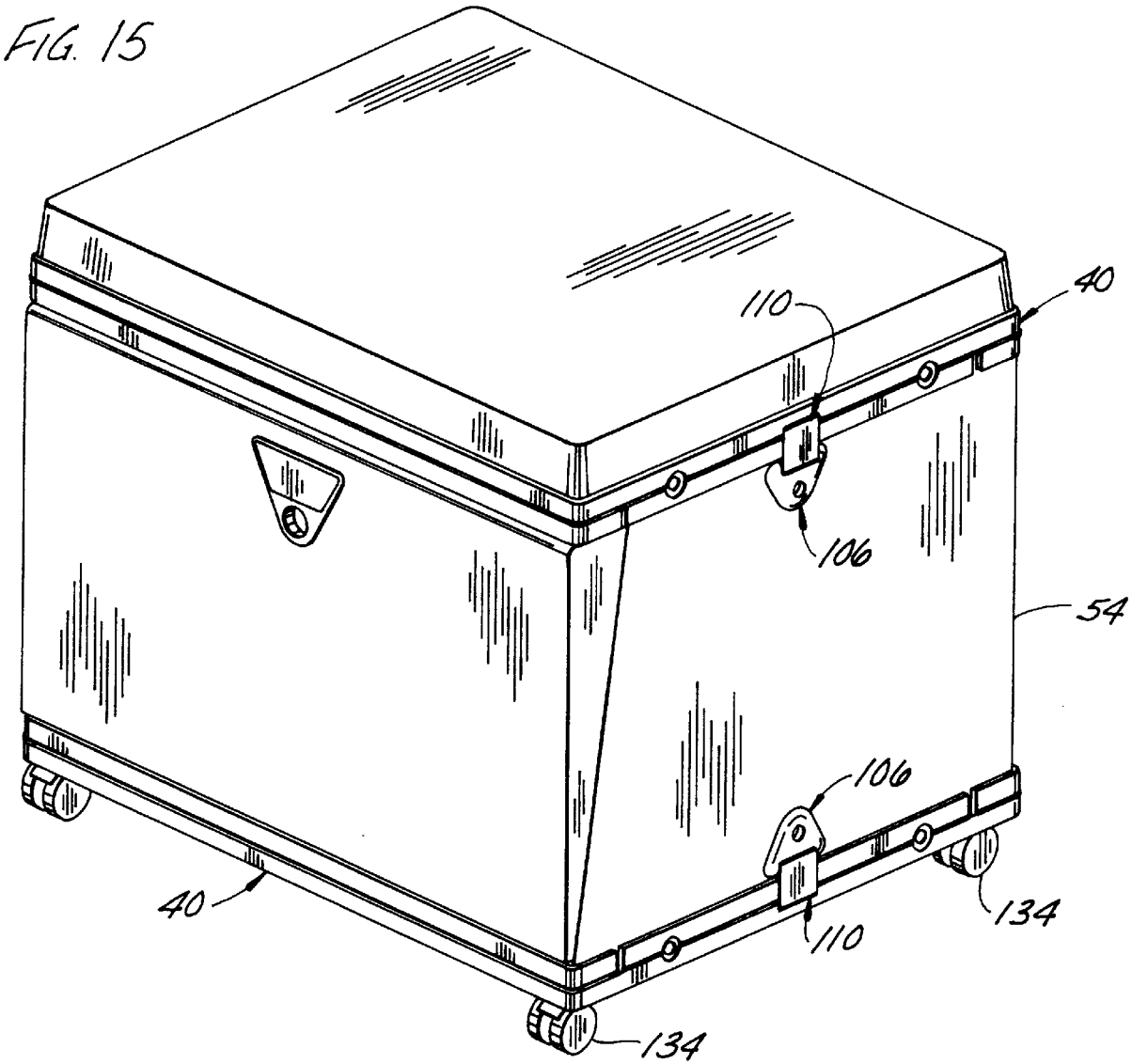
FIG. 15 is a perspective showing a file box assembly with castors.

As shown in FIG. 5, a receptacle 130 is provided at each corner of the frame 40 for receiving a support such as a leveling foot 132 (FIG. 12) or a castor 134 (FIG. 13). The foot 132 or castor 134 is inserted in the receptacles 130 of the lowermost frame 40 in an assembly. This enables movable furniture to be constructed in which castors 134 are fitted in the receptacles 130 to form a small movable chest-type file box as shown for example in FIGS. 14 and 15. Similarly, static furniture may be constructed by inserting feet 132 in the receptacles 130 as shown in FIG. 16.

Figure 16:
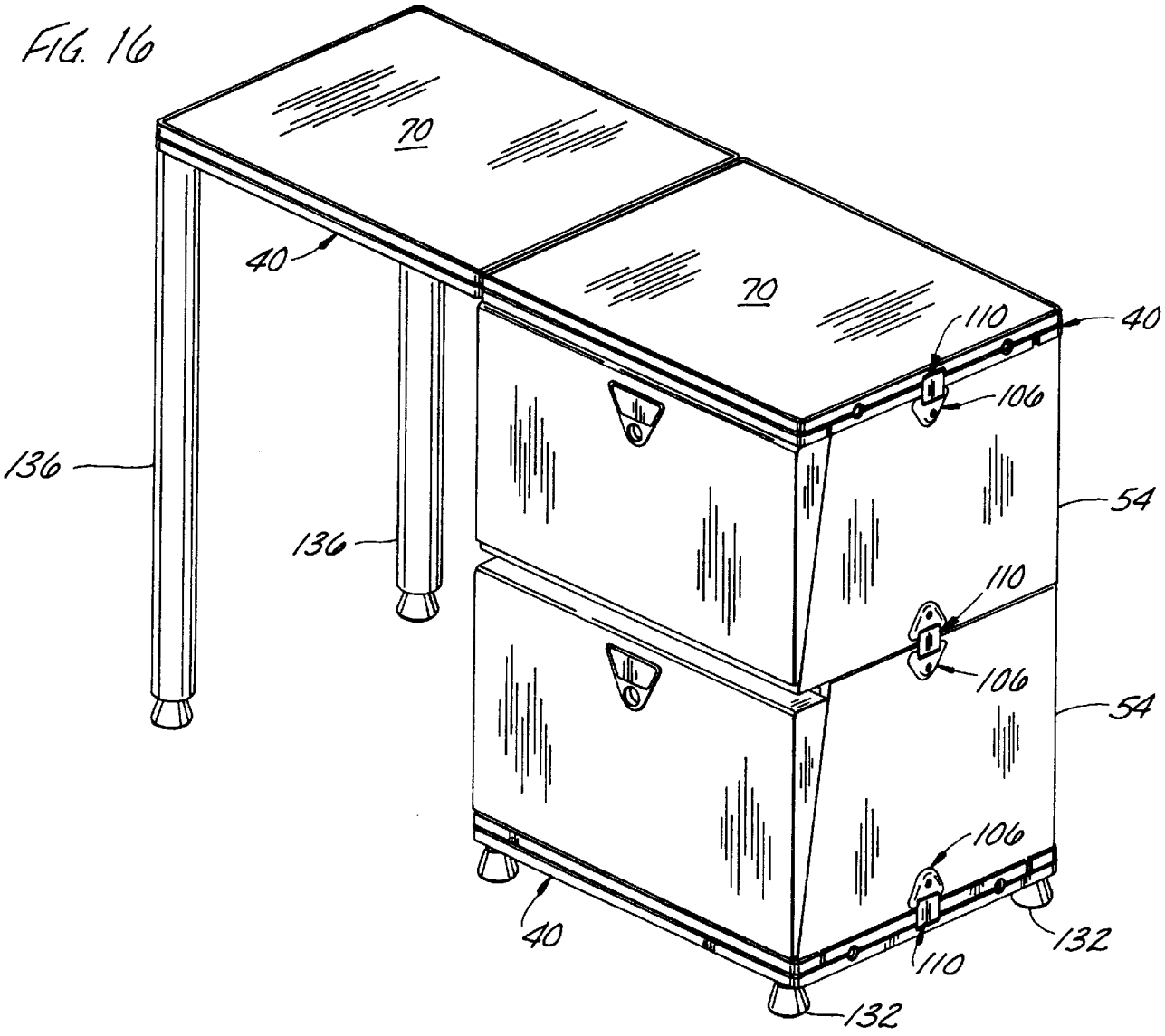
FIG. 16 is a perspective showing a small desk assembly.
Figure 17:
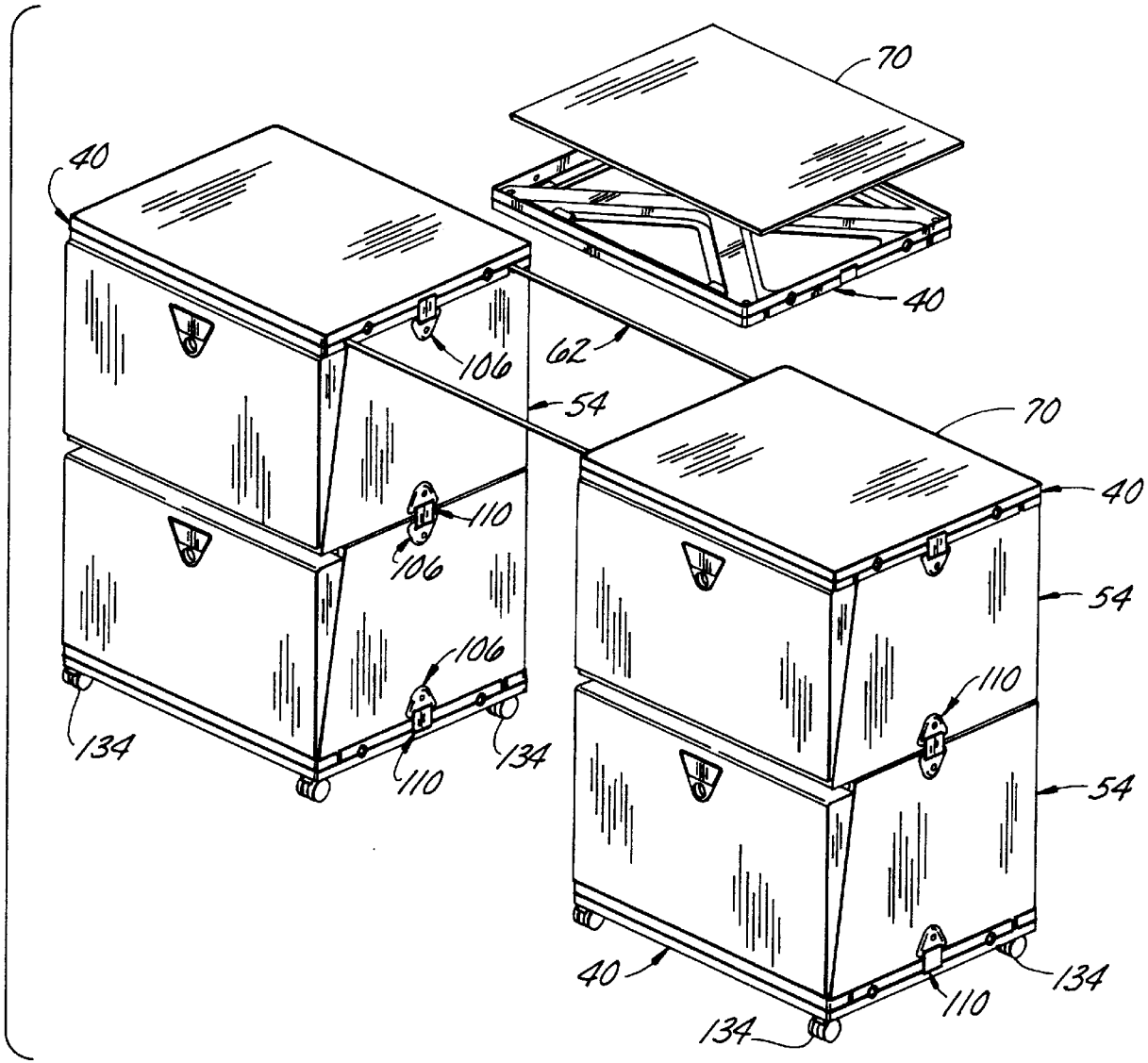
FIG. 17 is a partially exploded perspective showing another desk assembly.
Figure 18:
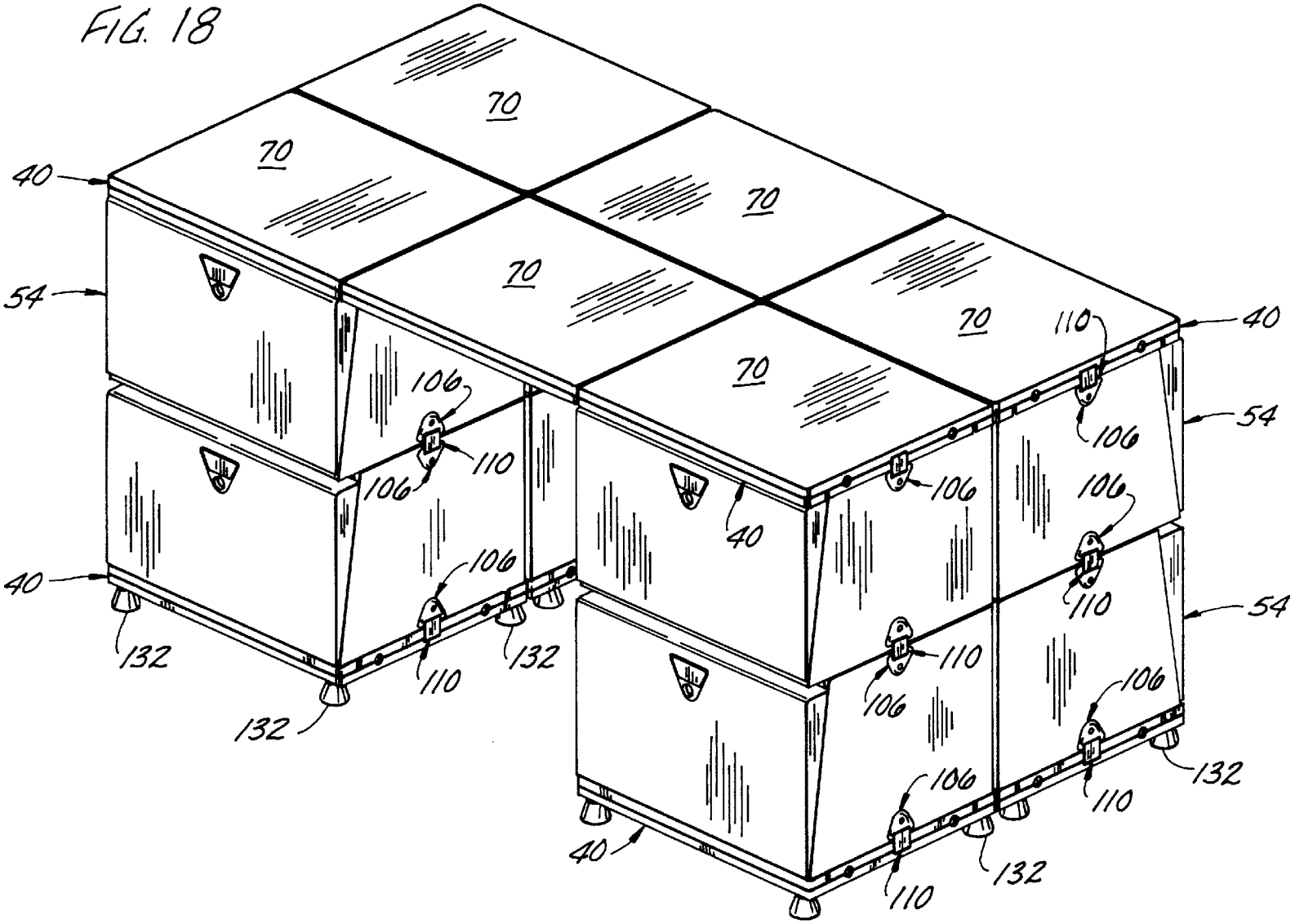
FIG. 18 is a perspective showing yet another desk assembly.
Figure 19:
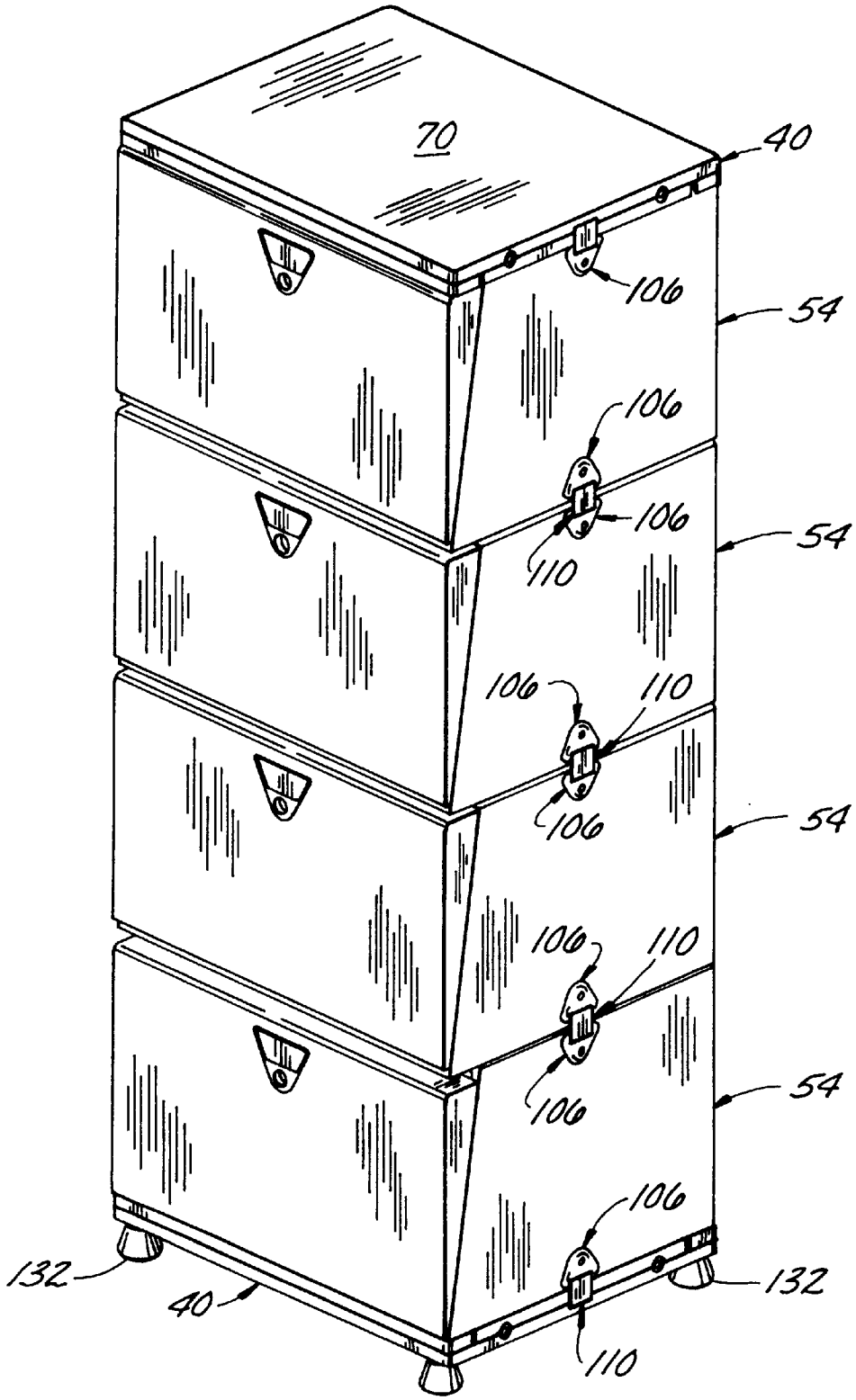
FIG. 19 is a perspective showing a filing cabinet assembly.

As further shown in FIG. 16, the receptacles 130 can also be used to attach legs 136 to the underside of an upper support frame 40 to form a single pedestal desk. other examples of desks are illustrated in FIGS. 17 and 18, and FIG. 19 illustrates a stack of file boxes 54 assembled to form a filing cabinet.

Figure 20:
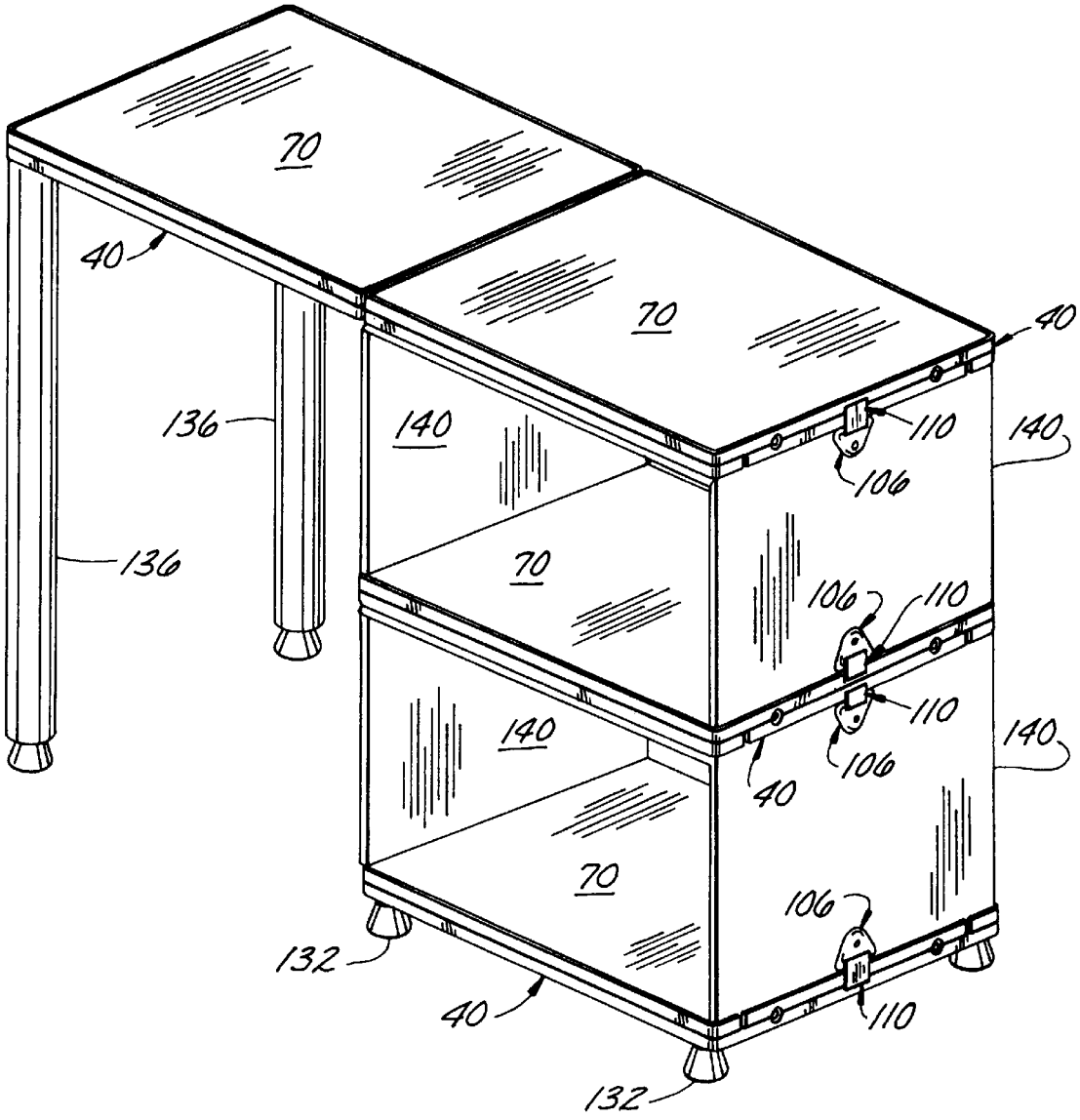
FIG. 20 is a perspective illustrating an alternative box-construction.

The system may also be used to form assemblies which do not comprise preformed file boxes, but instead incorporate flat panels 140 which form boxes when combined with the frame members. FIG. 20 illustrates a construction of this kind which forms a desk similar to that of FIG. 16. However, instead of stacking file boxes, a frame 40 supports side and back panels 140 to form an open-fronted box structure. Another frame 40 is placed on top of this structure, and in turn supports additional side and rear panels 140 which form another box structure. As before, the top of the structure is formed by a frame 40 and panel 70. Panels 70 are also inserted in each frame 40 to form the base of each box structure. The side panels 140 may be secured to the frames by a clip and socket as shown in FIGS. 7 and 8.

Alternatively, in the case of panels of reasonably thick material such as medium density fiberboard, they may be directly secured to the frames 40, for example with screws (not shown) passing through preformed holes in the frames. Vertical partitions or other suitable internal dividers may be provided inside the boxes.

Figure 22:
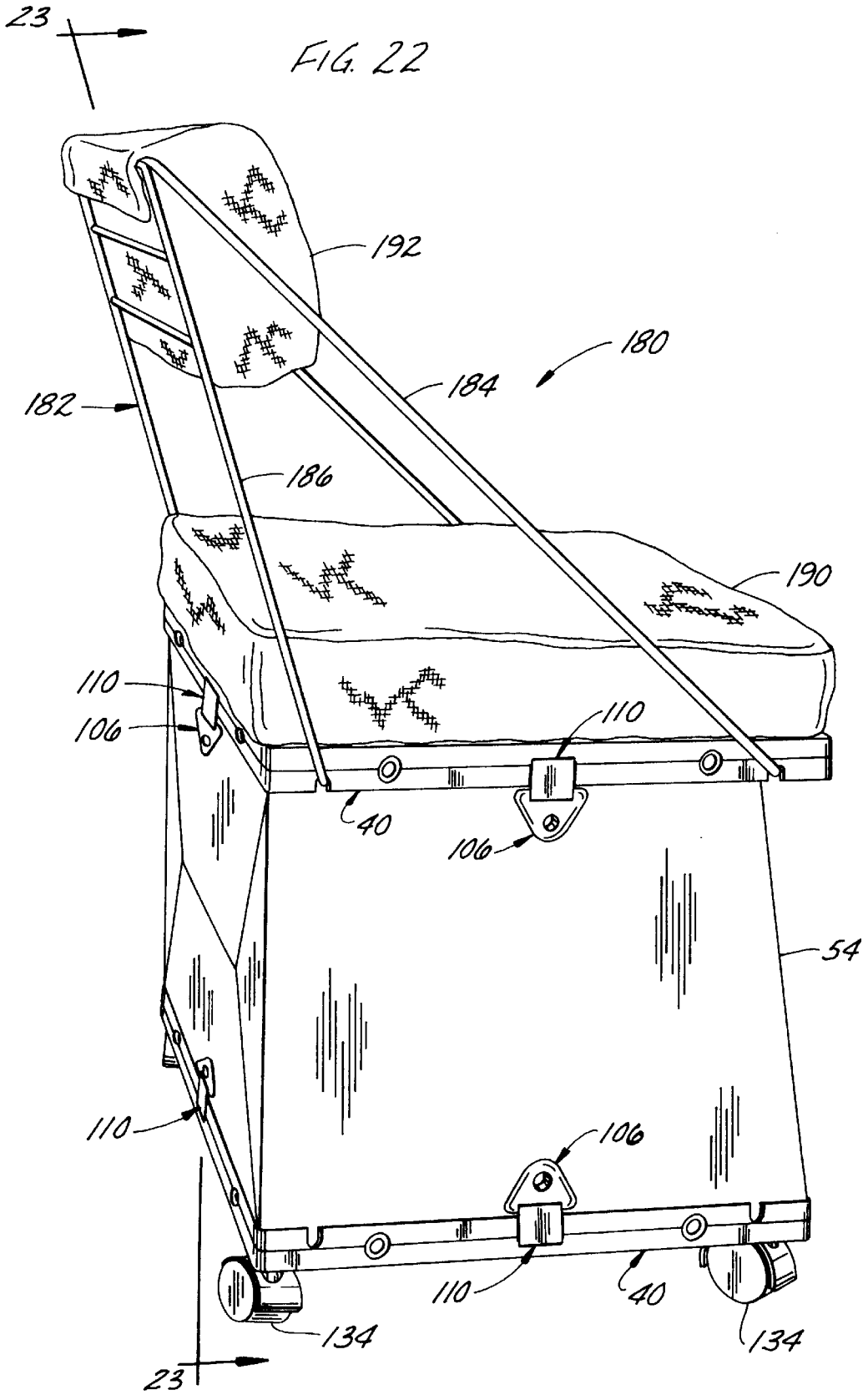
FIG. 22 is a perspective showing a seat assembly in accordance with the present invention.
Figure 23:
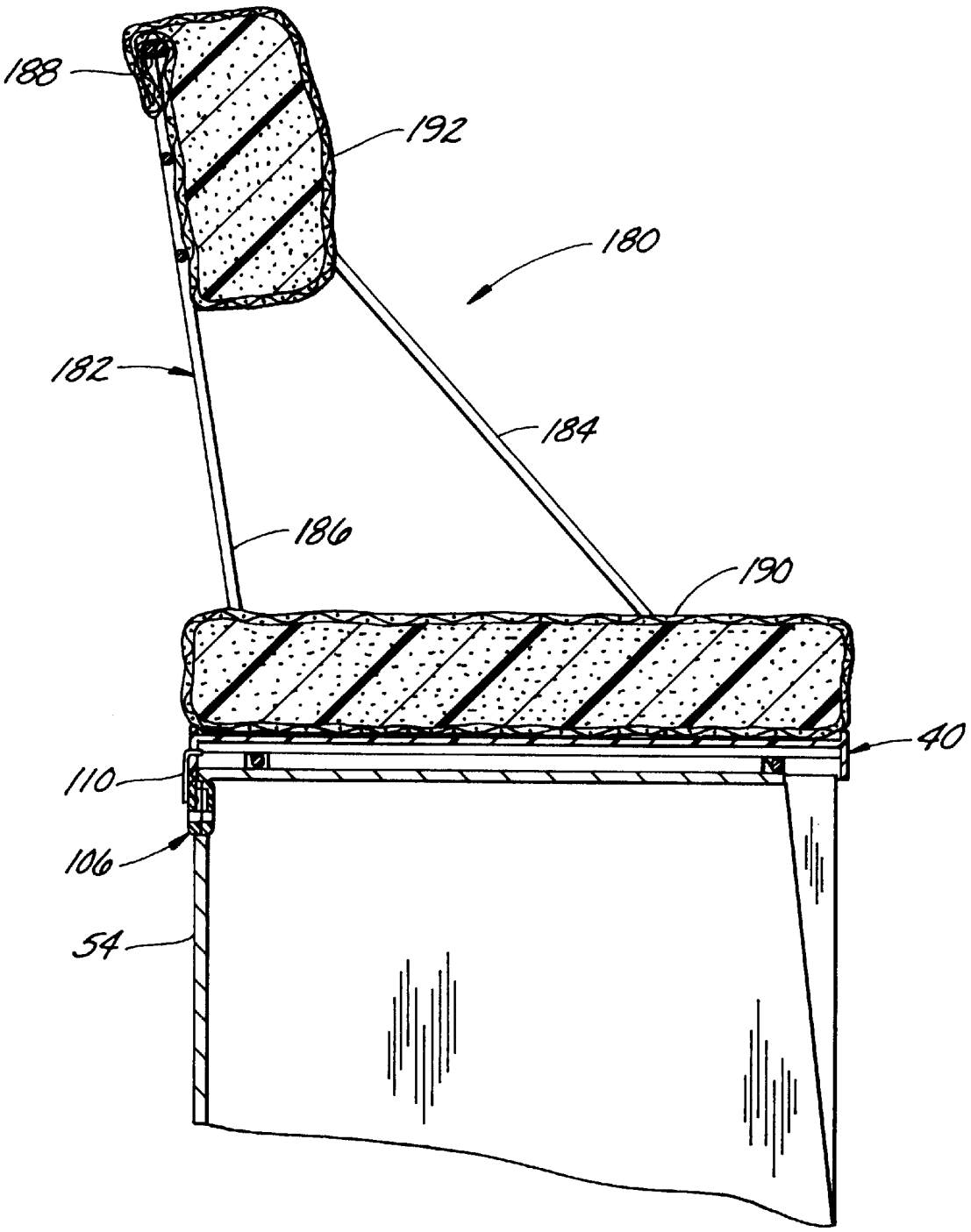
FIG. 23 is a cross section through the seat assembly taken in the plane of line 23—23 of FIG. 22.

FIG. 22 illustrates a chair, generally designated 180, made with the system of the present invention. The chair 180 comprises a file box 54 having frames 40 attached to its top and bottom with clips 110. A seat back, generally designated 182, is connected to the upper frame 40 by manually pressing it into the longitudinal channels 56 (FIG. 2) of the frame as shown in FIG. 23. The back 182 is formed from two rigid rectangular members 184, 186 joined by tubular connectors 188 at their upper ends. Although other materials may be used without departing from the scope of the present invention, the rectangular members 184, 186 of the preferred embodiment are made from steel rods. To complete the chair, a first cushion 190 is placed on the upper frame 40 and a second cushion 192 is fastened to the back 182 with hook and loop fasteners such as VELCRO® fasteners. VELCRO is a federally registered trademark owned by Velcro Industries, B.V. of Amsterdam. As will be appreciated by those skilled in the art, the tubular connectors 188 used to join the rectangular members 184, 186 enable the seat back 182 to be laid flat for shipment.

Figure 24:
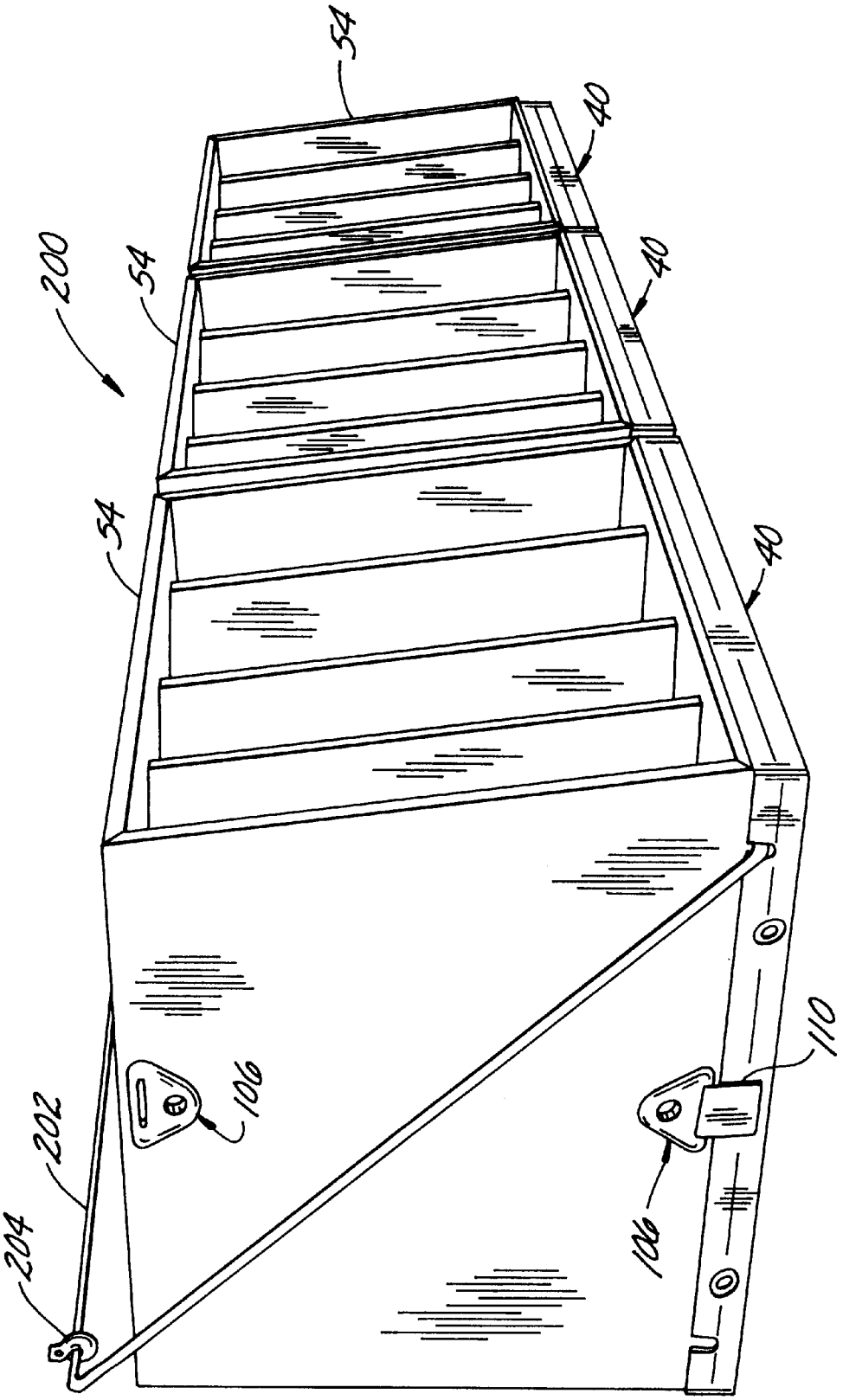
FIG. 24 is a perspective showing a wall storage assembly in accordance with the present invention.

FIG. 24 illustrates a wall-mounted shelving assembly, generally designated 200, constructed with the system of the present invention. The shelving assembly 200 is constructed by pressing a rigid rectangular wall bracket 202 into the longitudinal channel 56 (FIG. 2) of a frame 40 and connecting a file box 54 to the frame with clips 110. Connectors 204 and screw fasteners (not shown) are used to fasten the bracket 202 to a wall of a building (not shown) in a conventional manner. Screw fasteners are also used to fasten the frame 40 to the wall.

Figure 25:
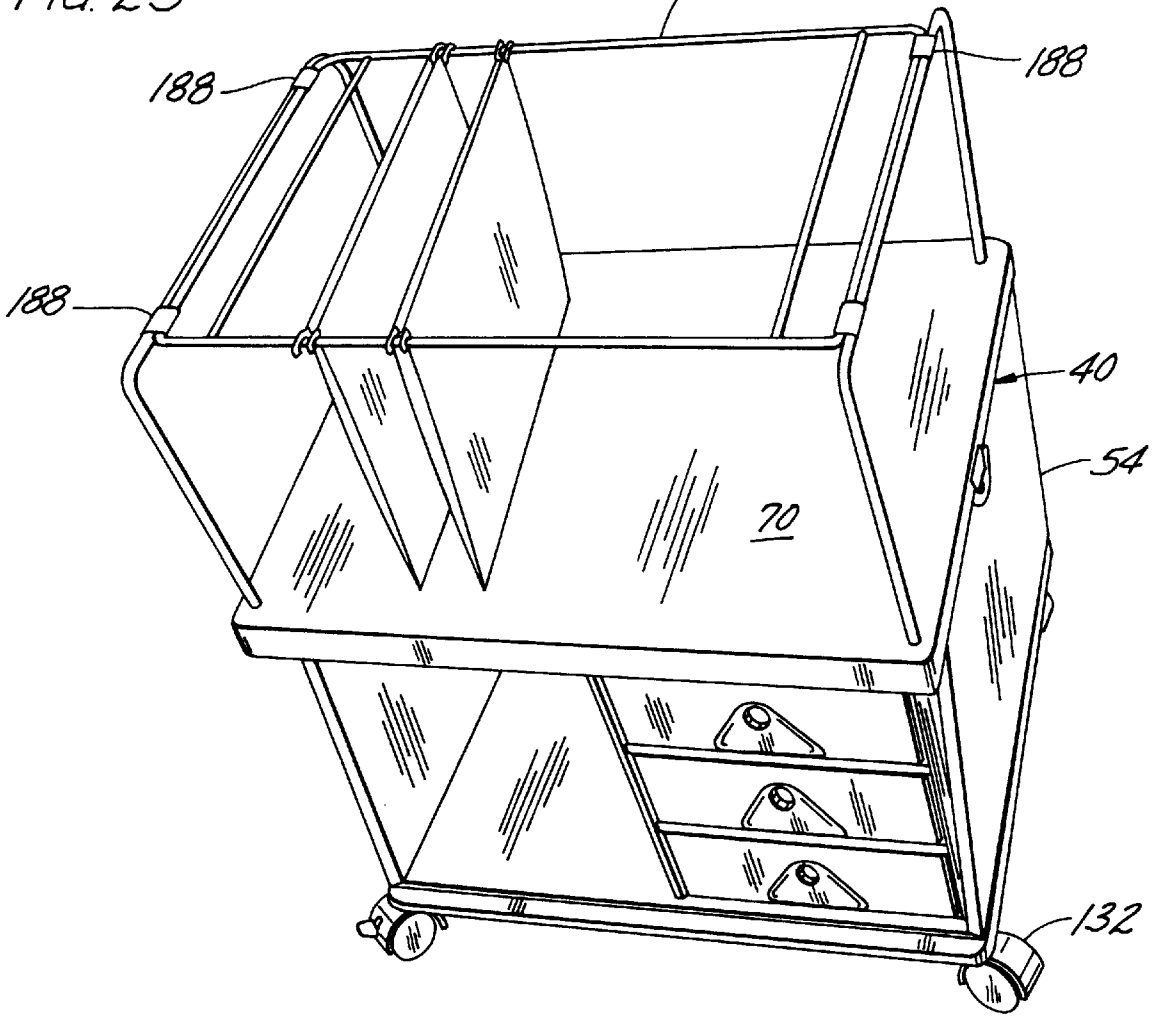
FIG. 25 is a perspective showing a standing file assembly in accordance with the present invention.

A standing file assembly 210 may be connected to the top of a frame 40 as shown in FIG. 25 to permit files to be hung from the assembly. Holes (not shown) extending through the top panel 70 permit the legs of the assembly 210 to be inserted in the receptacles 130 (FIG. 2) at the corners of the frame 40. As with the seat back 182, the elements forming the file assembly are joined by tubular connectors 188 so that the assembly may be laid flat for shipment.

Figure 26:
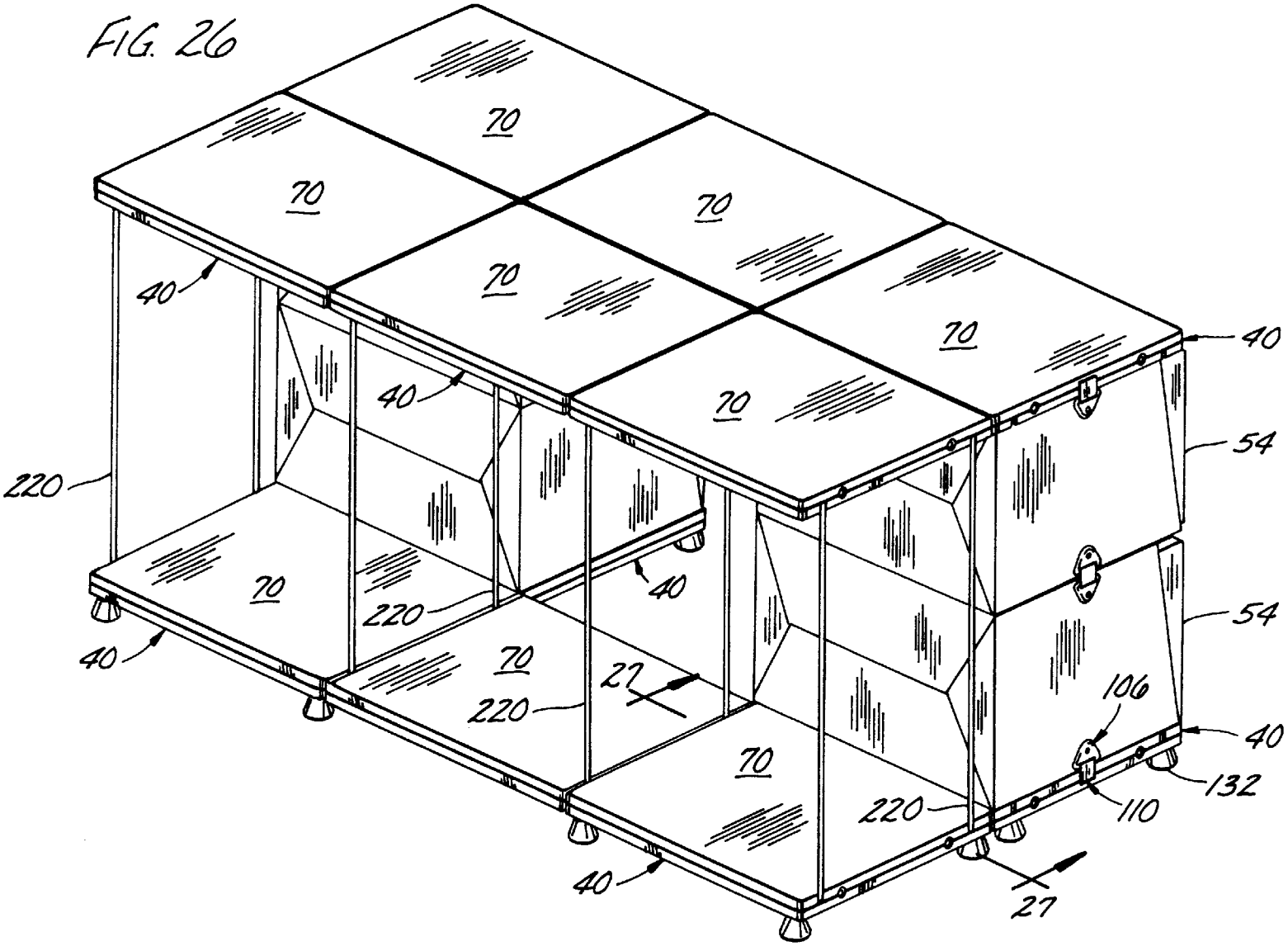
FIG. 26 is a perspective of a desk having spacers.
Figure 27:
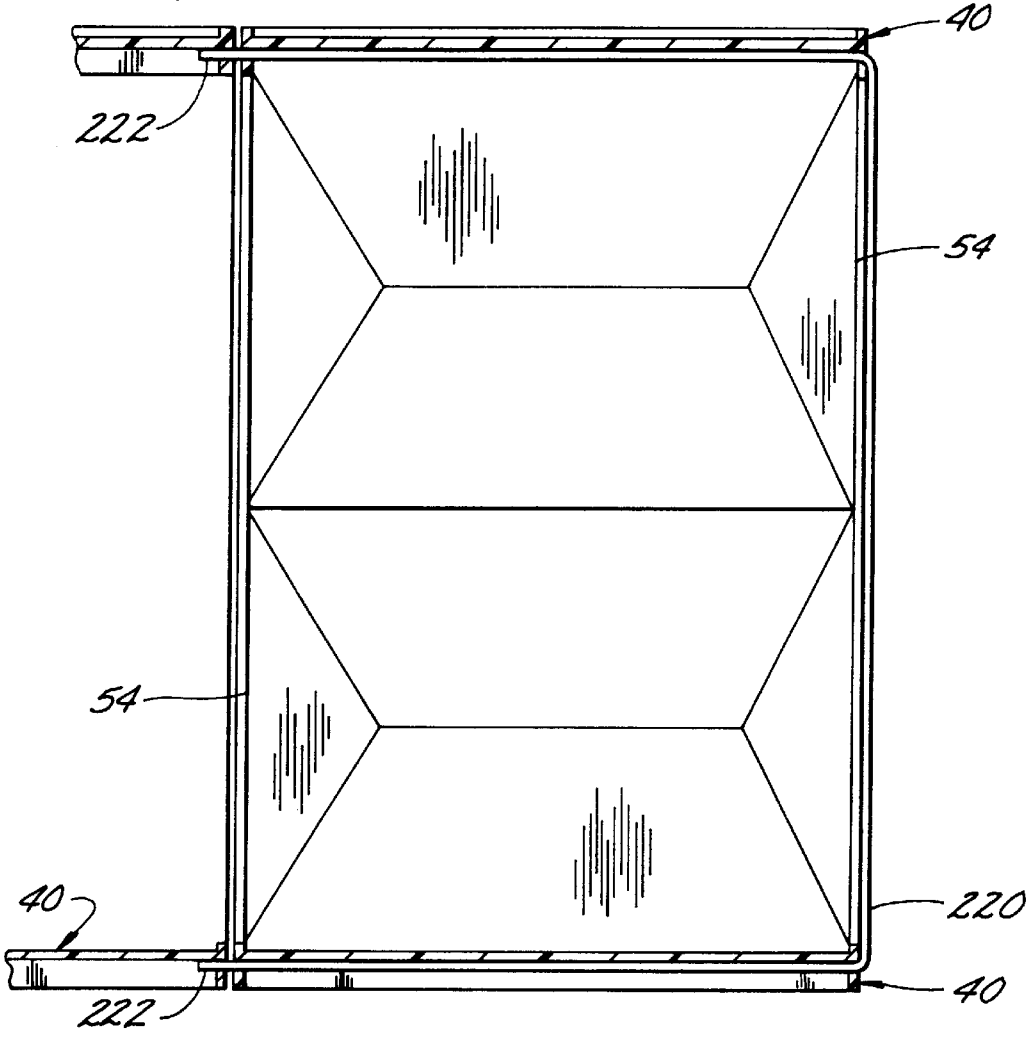
FIG. 27 is a fragmentary cross section through the spacers taken in the plane of line 27≦27 of FIG. 26.

As shown in FIG. 26, vertical spacers 220 may be used to space upper and lower frames 40, instead of using file boxes 54, for extending the upper surface of furniture such as desks. It is more desirable to use the spacers 220 than file boxes 54 when the contents of the boxes would not be accessible because the spacers are less expensive than the boxes. As shown in FIG. 27, the spacers 220 are rigid rectangular members which may be pressed into the longitudinal channels 56 (FIG. 2) in the frames and which may include stubs 222 extending from one or more corners. These stubs 222 permit frames 40 to be positioned between two spaced pairs of spacers 220 as shown in FIG. 26. The upper and lower frames 40 are connected to corresponding adjacent frames with plugs 84 as explained above to prevent the spacers 220 from rotating in the respective channels 56 of the frames 40. Although the spacers 220 of the illustrated embodiment are two boxes tall, the spacers may have other heights without departing from the scope of the present invention.

Figure 28:
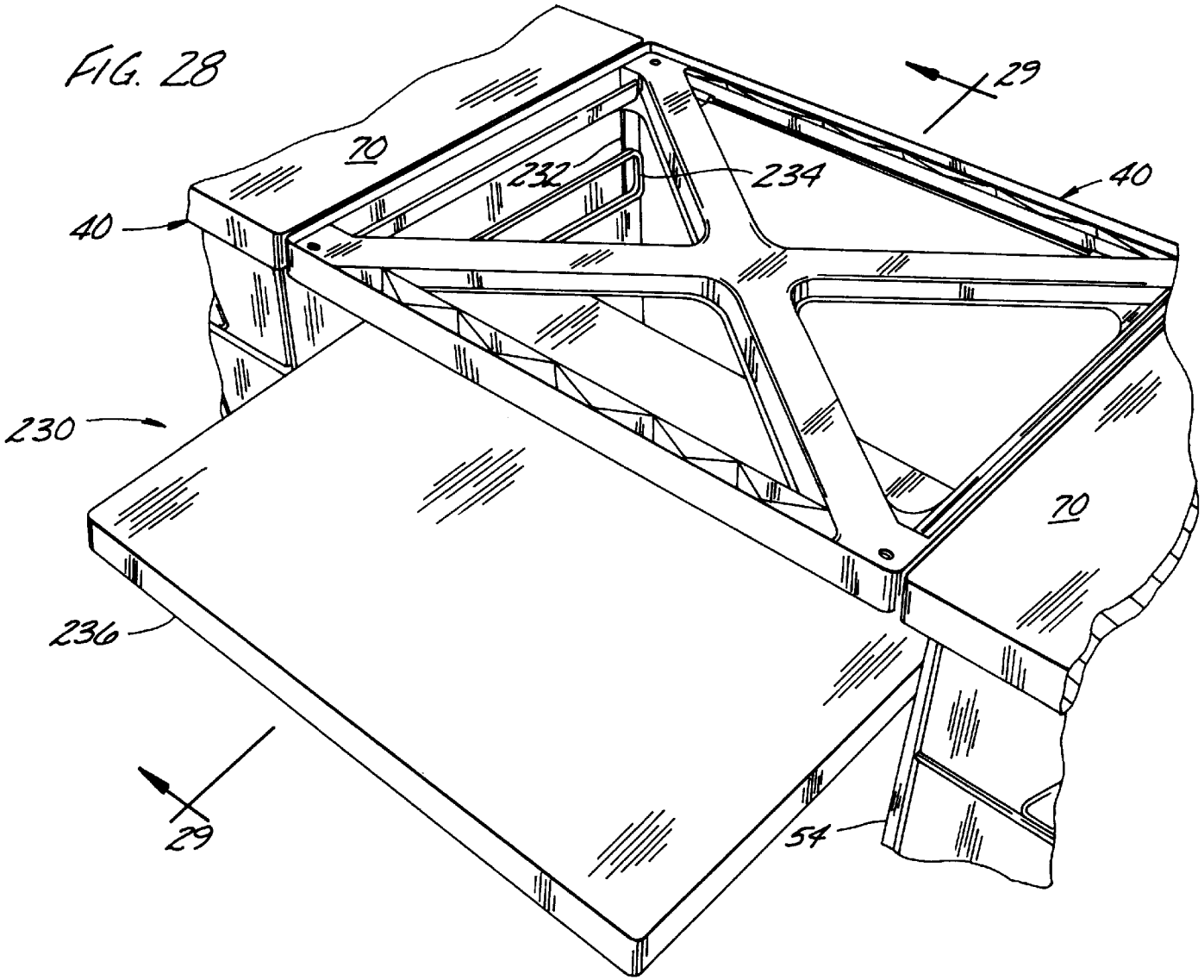
FIG. 28 is a perspective showing a sliding keyboard shelf of the present invention.
Figure 29:
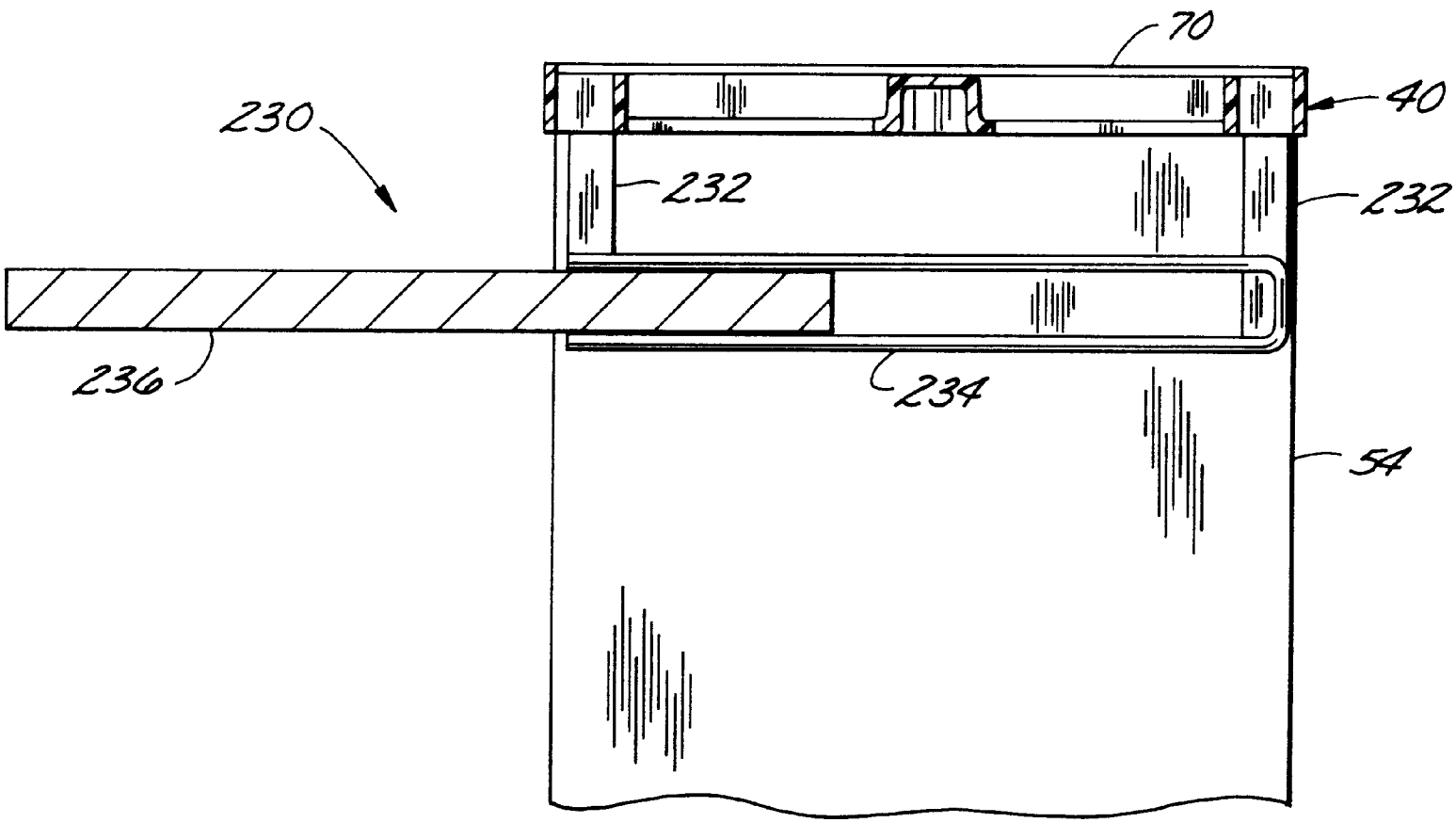
FIG. 29 is a cross section through the keyboard shelf taken in the plane of line 29—29 of FIG. 28.

A sliding keyboard shelf assembly, generally designated by 230, is shown in FIGS. 28 and 29. This assembly 230 is constructed by hooking brackets 232 over file boxes 54 which are connected by a bridging member 62 (FIG. 3). U-shaped supports 234 connected to the brackets 232 hold a shelf 236 so that it can slide back and forth on the supports. Thus, the shelf 236 may be extended for typing on a keyboard held by the shelf or retracted for storing the keyboard under the bridging member 62 when not in use.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A system for constructing modular furniture from one or more file boxes, said system comprising a rigid rectangular frame having top and bottom faces adapted to engage said file boxes, said top face having an upper rim extending up from the top face for surrounding a file box mounted on the top face, the upper rim defining an upper area, and said bottom face having a lower rim extending down from the bottom face for surrounding a file box mounted on the bottom face, the lower rim defining a lower area having a substantially equal size and shape to said upper area.

2. A system as set forth in claim 1 wherein said frame is a first frame and said system further comprises:

a second rigid rectangular frame having top and bottom faces adapted to engage said file boxes, said top face having an upper rim extending up from the top face for surrounding a file box mounted on the top face, the upper rim defining an upper area, and said bottom face having a lower rim extending down from the bottom face for surrounding a file box mounted on the bottom face, the lower rim defining a lower area having a substantially equal size and shape to said upper area; and a connector for connecting said first and second frames when positioned in side-by-side relation.

3. A system as set forth in claim 2 wherein said connector comprises a plug-and-socket connector.

4. A system as set forth in claim 3 wherein each of said first and second frames includes a socket extending into one of its respective rims, and said connector comprises a plug adapted to simultaneously engage said socket for connecting said first and second frames.

5. A system as set forth in claim 2 wherein:

each of said first and second frames includes an elongate channel on at least one of said top and bottom faces of the respective frames, each frame including at least one aperture corresponding to said elongate channel extending through one of its rims; and said connector comprises a bridging member adapted to simultaneously engage said channels in said first and second frames and to extend through the apertures extending through the respective rims of said first and second frames for connecting said first and second frames in side-by-side relation.

6. A system as set forth in claim 5 further comprising a keyboard shelf assembly adapted to be connected below the bridging member for supporting a keyboard below the bridging member.

7. A system as set forth in claim 1 further comprising a connector for connecting said frame to a file box mounted on one of said top and bottom faces of the frame.

8. A system as set forth in claim 7 wherein:

the connector includes a C-shaped clip having at least two legs;

the frame includes an opening adapted to releasably receive one of said legs of the clip; and another of said legs of the clip adapted for engagement with an opening in a file box.

9. A system as set forth in claim 1 wherein said frame includes a receptacle on at least one of said top and bottom faces adapted to receive and locate a support member for supporting the frame.

10. A system as set forth in claim 1 wherein said frame includes a receptacle on at least one of said top and bottom faces adapted to receive and locate a standing file for holding paper files.

11. A system as set forth in claim 1 further comprising a seat back adapted to engage with the frame for constructing a chair from a file box and the frame.

12. A system as set forth in claim 1 further comprising a wall bracket adapted to engage with the frame to suspend the frame from a wall of a building.

13. A system as set forth in claim 1 wherein said frame is a first frame and said system further comprises:

a second rigid rectangular frame having top and bottom faces adapted to engage said file boxes, said top face having an upper rim extending up from the top face for surrounding a file box mounted on the top face, the upper rim defining an upper area, and said bottom face having a lower rim extending down from the bottom face for surrounding a file box mounted on the bottom face, the lower rim defining a lower area having a substantially equal size and shape to said upper area; and a spacer for connecting said first and second frames in a position where said second frame is spaced above said first frame.

14. A system as set forth in claim 1 further comprising a file box having opposite upper and lower surfaces, said upper surface having an upper perimeter sized and shaped for receipt in the lower rim of the frame, and said lower surface having a lower perimeter sized and shaped for receipt in the upper rim of the frame.

* * * * *